US008596668B2

(12) United States Patent
Van Bregmann, Jr.

(10) Patent No.: US 8,596,668 B2
(45) Date of Patent: Dec. 3, 2013

(54) ROTATIONALLY ADJUSTABLE ADAPTER FOR SPORT BOOT BINDING

(75) Inventor: Peter R. Van Bregmann, Jr., Santa Barbara, CA (US)

(73) Assignee: Van Bregmann Industries, Inc., Santa Barbara, CA (US)

( * ) Notice: Subject to any disclaimer, the term of this patent is extended or adjusted under 35 U.S.C. 154(b) by 138 days.

(21) Appl. No.: 13/194,729

(22) Filed: Jul. 29, 2011

(65) Prior Publication Data

US 2012/0025490 A1 Feb. 2, 2012

Related U.S. Application Data

(60) Provisional application No. 61/369,253, filed on Jul. 30, 2010.

(51) Int. Cl.
*A63C 9/02* (2012.01)

(52) U.S. Cl.
USPC ..... 280/618; 280/14.24

(58) Field of Classification Search
USPC ..... 280/607, 613, 617, 618, 14.24
See application file for complete search history.

(56) References Cited

U.S. PATENT DOCUMENTS

| | | | | |
|---|---|---|---|---|
| 5,021,017 | A | 6/1991 | Ott | |
| 5,236,216 | A | 8/1993 | Ratzek | |
| 5,261,689 | A | 11/1993 | Carpenter et al. | |
| 5,277,635 | A | 1/1994 | Gillis | |
| 5,354,088 | A | 10/1994 | Vetter et al. | |
| 5,499,837 | A | 3/1996 | Hale et al. | |
| 5,577,755 | A | 11/1996 | Metzger et al. | |
| 5,586,779 | A | 12/1996 | Dawes et al. | |
| 5,667,237 | A | 9/1997 | Lauer | |
| 5,791,678 | A * | 8/1998 | Perlman | 280/618 |
| 5,876,045 | A | 3/1999 | Acuna, Jr. | |
| 5,984,325 | A | 11/1999 | Acuna | |
| 6,575,489 | B1 | 6/2003 | White | |
| 6,910,707 | B1 * | 6/2005 | Lyng | 280/618 |
| 6,923,454 | B2 | 8/2005 | Drako | |
| 7,281,717 | B2 | 10/2007 | Sacco et al. | |
| 7,384,048 | B2 * | 6/2008 | Cerrito | 280/14.22 |
| 2003/0011171 | A1 * | 1/2003 | Battistella | 280/618 |
| 2003/0230870 | A1 * | 12/2003 | Sabol | 280/618 |
| 2007/0187911 | A1 | 8/2007 | Morley | |

FOREIGN PATENT DOCUMENTS

| | | | |
|---|---|---|---|
| DE | 4034099 | A1 | 8/1991 |
| EP | 0432588 | A2 | 6/1991 |
| WO | WO 92/09339 | A1 | 6/1992 |
| WO | WO 2004/069350 | A2 | 8/2004 |

OTHER PUBLICATIONS

International Search Report and Written Opinion regarding PCT/US2011/045997 mailed Nov. 11, 2011 (14 pages).

* cited by examiner

*Primary Examiner* — John Walters
(74) *Attorney, Agent, or Firm* — Knobbe, Martens, Olson & Bear, LLP

(57) ABSTRACT

An adapter enables a rider to adjust an angular orientation of a binding relative to a sport board without removing a foot, comprising a base plate, a top plate, and a locking mechanism supported by the top plate having a pair of insertion members configured to selectively engage a plurality of recesses formed in the base plate. The top plate and base plate can each have a center opening and a fastener supported by the center opening of each of the top plate and base plate to axially couple the top plate to the base plate.

21 Claims, 12 Drawing Sheets

ROTATIONALLY ADJUSTABLE ADAPTER FOR SPORT BOOT BINDING

CROSS-REFERENCE TO RELATED APPLICATIONS

The present application claims priority from U.S. Patent Application No. 61/369,253, filed Jul. 30, 2010, the content of which is incorporated herein by reference in its entirety as if fully set forth herein.

BACKGROUND OF THE DISCLOSURE

1. Field of the Disclosure

The present disclosure generally relates to sporting equipment having at least one binding mounted on a platform. More particularly, the present disclosure relates to such sporting equipment wherein the binding is selectively releasable to pivot or rotate about a generally vertical axis without requiring removal of a boot from the binding.

2. Description of the Related Art

The sport of snowboarding has been practiced now for numerous years and has gained tremendous popularity across the country and throughout the world. A snowboarder typically wears snowboarding boots that are firmly held into boot bindings. The bindings are rigidly attached to the board to allow the user to properly maneuver the board when riding. Different from skiing, however, the snowboarder places both feet onto a single board, one in front of the other, and typically stands at an angle to the direction of travel. Each rider may set the angle of the feet differently but the feet typically remain at an angle to the direction of travel.

With reference to FIG. 1, when moving toward a ski lift or when maneuvering on generally flat ground, a snowboarder generally removes one foot from the snowboard and pushes the snowboard along while maintaining the other foot locked at an awkward angle on the board relative to the direction of travel. Riding or moving the snowboard with the user's front foot locked in the inward pointing direction exerts a considerable amount of force on the rider's front knee, leg and hip.

SUMMARY OF SOME EMBODIMENTS

Accordingly, an aspect involves a system and method that would allow a snowboarder to easily and repeatedly adjust the angle of a foot to any angle, including an angle relative to a longitudinal direction of a snowboard. The system can be configured to allow one to adjust the angle of the foot without removing the foot from the binding. More preferably, the system would allow one to adjust the angle of the foot without necessarily reaching down to the foot.

In some configurations, the system would allow one to adjust the angle of the foot by pulling up on a release mechanism to allow the foot to pivot relative to the longitudinal direction of the snowboard. In some more preferred configurations, the system would allow one to adjust the angle of the foot by pulling up on the release mechanism along an axis that is generally parallel to a pin of the locking mechanism.

A first arrangement disclosed herein is directed to a rotationally adjustable binding mount configured to permit a user to adjust an angular orientation of a binding relative to a sport board without removing the user's foot therefrom. In some variations, the binding mount can have a base plate or member, a top plate or member, and a locking member. In some variations, the base plate can comprise a center opening that is coaxial with a center axis defined through the axial center of the binding mount and a plurality of base plate mounting holes spaced apart from the center opening. The base plate mounting holes can be sized and positioned to mount the base plate to a recreational board of any configuration and for any use, and at least two pairs of recesses radially positioned in the base plate. Each recess can be approximately equidistant from the center axis and each recess of each pair of recesses can be separated by a fixed distance. Further, some arrangements of the top plate can comprise a center opening that is coaxial with the center axis of the binding mount, and at least two top plate mounting holes spaced apart from the center opening of the top plate, The locking mechanism can comprise a body member coupled with the top plate, a top member, and a pair of insertion members each supported at a first end thereof by the top member and can be configured to pass through the body member. The pair of insertion members can be spaced apart from one another by a distance that is approximately equal to the fixed distance between each recess of each pair of recesses such that the pair of insertion members can engage with each pair of recesses.

In some versions of the first arrangement, the top member can be configured to move in an axial direction relative to the body member between a first and a second position, thereby causing the pair of insertion members to move between a first position wherein the pair of insertion members are axially spaced apart from each of the recesses of the base plate and a second position wherein the pair of insertion members are axially engaged with at least a pair of the recesses of the base plate. Further, the top plate can be coupled with the base plate so that the top plate can rotate about the center axis relative to the base plate when the locking mechanism is in a first, disengaged position.

Further versions of the first arrangement disclosed herein are directed to:

- a binding mount according to the first arrangement that can further comprise one or more access openings formed in the top plate and spaced apart from the center opening, the access openings being configured to permit a user to access one or more of the plurality of mounting holes formed in the base plate by rotating the top plate until the access opening is sufficiently aligned with the mounting hole such that a user can pass a fastener through the access opening and into the mounting hole and threadingly engage the fastener with the board without removing the top plate from the base plate;
- a binding mount according to the first arrangement and any variations and combinations of variations thereof that can further comprise a pair of access holes formed in the top plate, the access holes can be configured to permit a user to access one or more of the plurality of mounting holes formed in the base plate so that a user can attach the adapter plate to the board without removing the top plate from the base plate;
- a binding mount according to the first arrangement and any variations and combinations of variations thereof that can further comprise a first fastener received by the center opening of the base plate coupled with second fastener received by the center opening of the top plate, the first and second threaded fasteners configured to prevent the axial movement of the top plate relative to the base plate;
- a binding mount according to the first arrangement and any variations and combinations of variations thereof, wherein the insertion members are each biased toward the second position by one or more springs;
- a binding mount according to the first arrangement and any variations and combinations of variations thereof, wherein the insertion members pass through sealed openings formed in the body member of the locking mechanism, the sealed openings configured to substantially prevent water, moisture, snow, ice, dirt, or debris from entering the body member through the openings;

a binding mount according to the first arrangement and any variations and combinations of variations thereof, wherein the base plate can comprise a continuous array of equally spaced recesses;

a binding mount according to the first arrangement and any variations and combinations of variations thereof, wherein each of the recesses is separated by approximately 4 degrees;

a binding mount according to the first arrangement and any variations and combinations of variations thereof, that can further comprise a strap mounted to the top member such that a center portion of a first end of the strap is substantially aligned with a center of the top member;

a binding mount according to the first arrangement and any variations and combinations of variations thereof that can further comprise a bearing plate positioned between the top plate and the base plate; and a pair of binding mounts that can comprise the rotationally adjustable binding mount of the first arrangement and any variations and combinations of variations thereof for positioning beneath a forward-most binding, and an adapter plate that can comprise only a plate member for positing beneath a rearward-most binding.

A second arrangement disclosed herein is directed to a rotationally adjustable binding mount configured to permit a user to adjust an angular orientation of a binding relative to a recreational board without removing the user's foot therefrom. In some versions of the second arrangement, the binding adapter can comprise a first mounting member, a second mounting member, a fastener element received within the center opening of the first mounting member and the center opening of the second mounting member to axially couple the first mounting member to the second mounting member, and a locking element. The locking element can be configured to move between at least a first position wherein the locking element is received by each recess of one or more of the at least two recesses and a second position wherein the locking element is configured to be spaced apart from all of the recesses of the at least two pairs of recesses such that the top mounting member is rotatable relative to the recreational board.

In some versions of the second arrangement, the first mounting member can comprise a center opening that is coaxial with a center axis defined through the axial center of the binding adapter, a plurality of mounting holes spaced apart from the center opening The mounting holes can be sized and positioned to mount the first mounting member to a recreational board, and at least two pairs of recesses radially positioned in the first mounting member, wherein each recess is approximately equidistant from the center axis and each recess of each pair of recesses is separated by a fixed distance. In some versions of the second arrangement, the second mounting member can comprise a center opening that is coaxial with the center axis of the binding adapter, and at least two mounting holes spaced apart from the center opening of the second mounting member for receiving mounting hardware for a binding.

Further versions of the second arrangement disclosed herein are directed to:

a binding mount according to the second arrangement and any variations and combinations of variations thereof, further comprising one or more access openings formed in the top plate and spaced apart from the center opening, the access openings being configured to permit a user to access one or more of the plurality of mounting holes formed in the base plate by rotating the top plate until the access opening is sufficiently aligned with the mounting hole that a user can pass a fastener through the access opening and into the mounting hole and threadingly engage the fastener with the board without removing the top plate from the base plate;

a binding mount according to the second arrangement and any variations and combinations of variations thereof, wherein the locking element can comprise a pair of insertion members each supported at a first end thereof by the top member and can be configured to pass through the body member, the pair of insertion members can be spaced apart from one another by a distance that is approximately equal to the fixed distance between each recess of each pair of recesses such that the pair of insertion members can engage with each pair of recesses;

a binding mount according to the second arrangement and any variations and combinations of variations thereof that can further comprise one or more access openings formed in the second mounting member and spaced apart from the center opening, the one or more access openings can be alignable with at least one of the mounting holes of the first mounting member by rotating the second mounting member relative to the first mounting member;

a binding mount according to the second arrangement and any variations and combinations of variations thereof that can further comprise a pair of access holes formed in the second mounting member, the access holes being configured to permit a user to access one or more of the plurality of mounting holes formed in the first mounting member so that a user can attach the adapter plate to the board without removing the second mounting member from the first mounting member;

a binding mount according to the second arrangement and any variations and combinations of variations thereof or any dependent arrangements or combinations thereof, that can further comprise a first fastener received by the center opening of the first mounting member coupled with second fastener received by the center opening of the second mounting member, the first and second threaded fasteners configured to prevent the axial movement of the second mounting member relative to the first mounting member; and a binding mount according to the second arrangement and any variations and combinations of variations thereof, wherein the first mounting member can comprise a continuous array of equally spaced recesses.

A third arrangement disclosed herein is directed to a method of mounting a rotationally adjustable binding adapter for a sport boot binding to a sport board as a single unit. In some variations of the third arrangement, the method can comprise positioning the rotationally adjustable binding adapter on a top surface of the sport board, rotating the top plate relative to the base plate to align an access opening with a first mounting opening formed in the base plate, advancing a first fastener through the access opening and the first mounting opening, and threadingly engaging the first fastener with a first threaded opening formed in the board.

In some variations of the third arrangement, the rotationally adjustable binding adapter can have a base plate, a top plate, and a locking mechanism. Some variations of the third arrangement can comprise rotating the top plate relative to the base plate to align the access opening with a second mounting opening formed in the base plate, advancing a second fastener through the access opening and the second mounting opening, and threadingly engaging the second fastener with a second threaded opening formed in the board.

Further versions of the third arrangement disclosed herein are directed to:

- a method of mounting a rotationally adjustable binding adapter for a sport boot binding to a sport board according to the third arrangement and any variations and combinations of variations thereof, further comprising disengaging a locking mechanism supported by the top plate from engagement with the base plate before rotating the top plate relative to the base plate;
- a method of mounting a rotationally adjustable binding adapter for a sport boot binding to a sport board according to the third arrangement and any variations and combinations of variations thereof, wherein disengaging the locking mechanism supported by the top plate from engagement with the base plate before rotating the top plate relative to the base plate can comprise lifting a top member of the locking mechanism in an axial direction away from the base plate so as to disengage a pair of insertion members from the base plate;
- a method of mounting a rotationally adjustable binding adapter for a sport boot binding to a sport board according to the third arrangement and any variations and combinations of variations thereof, further comprising releasing the locking mechanism so as to permit the locking mechanism to engage with the base plate to prevent the top plate from rotating relative to the base plate; and
- a method of mounting a rotationally adjustable binding adapter for a sport boot binding to a sport board according to the third arrangement and any variations and combinations of variations thereof, further comprising adjusting a rotational position of the top plate relative to the base plate by lifting up on the locking mechanism, rotating the top plate from a first rotational position to a second rotational position relative to the base plate, and releasing the locking mechanism so that the locking mechanism engages at least a pair of openings formed in the base plate.

Further arrangements disclosed herein are directed to a rotationally adjustable binding mount configured to permit a user to adjust an angular orientation of a binding relative to a sport board without removing the user's foot therefrom. In some embodiments, the binding mount can be mounted to the sport board without disassembling the various components of the binding mount, so that the binding mount assembly can be mounted to the board as a single unit right out of the box. For example but without limitation, some embodiments of the binding mount can have a base plate or member, a top plate or member, and a locking member, and the all three components can be mounted to the board in an assembled state, i.e., without disassembling the base member from the top member or the locking member from the top member. Access openings in the top member can be aligned with fastener holes in the base member so that fasteners can be passed through the access holes through the fastener holes and fastened to the board. The access openings can be aligned with the fastener holes in the base member by rotating the top member relative to the base member. In some embodiments, the locking member can have two, or two or more, insertion members (also referred to herein as pins) that are engaged or received by an equal number of recesses in the base member to selectively rotationally secure the top member to the base member. The insertion members can be withdrawn from the recesses to permit the top member to rotate relative to the base member. A binding can be mounted to the binding mount by fastening the binding to the top member so that the binding can be rotated along with the top member relative to the base member and the board.

In some variations of this arrangement, the base plate can comprise a center opening that is coaxial with a center axis defined through the axial center of the binding mount and a plurality of base plate mounting holes spaced apart from the center opening. The base plate mounting holes can be sized and positioned to mount the base plate to a recreational board of any configuration and for any use, and at least two pairs of recesses radially positioned in the base plate, wherein each recess is approximately equidistant from the center axis and each recess of each pair of recesses is separated by a fixed distance. Further, some arrangements of the top plate can comprise a center opening that is coaxial with the center axis of the binding mount, and at least two top plate mounting holes spaced apart from the center opening of the top plate, The locking mechanism can comprise a body member coupled with the top plate, a top member, and a pair of insertion members each supported at a first end thereof by the top member and that can be configured to pass through the body member. The pair of insertion members can be spaced apart from one another by a distance that is approximately equal to the fixed distance between each recess of each pair of recesses such that the pair of insertion members can engage with each pair of recesses.

Further arrangements disclosed herein are directed to a rotationally adjustable binding mount configured to permit a user to adjust an angular orientation of a binding relative to a sport board without removing the user's foot therefrom. In some embodiments, a first member can be mounted to the board and a second member can be coupled with the first member using a fastener that is approximately coaxially aligned with the centerline axis of the binding mount. The second member can be configured to rotate about the fastener relative to the second member.

BRIEF DESCRIPTION OF THE DRAWINGS

These and other features, aspects and advantages of the present invention will be described with reference to drawings of a preferred configuration.

DETAILED DESCRIPTION OF SOME EXEMPLIFYING EMBODIMENTS

Figure 1:
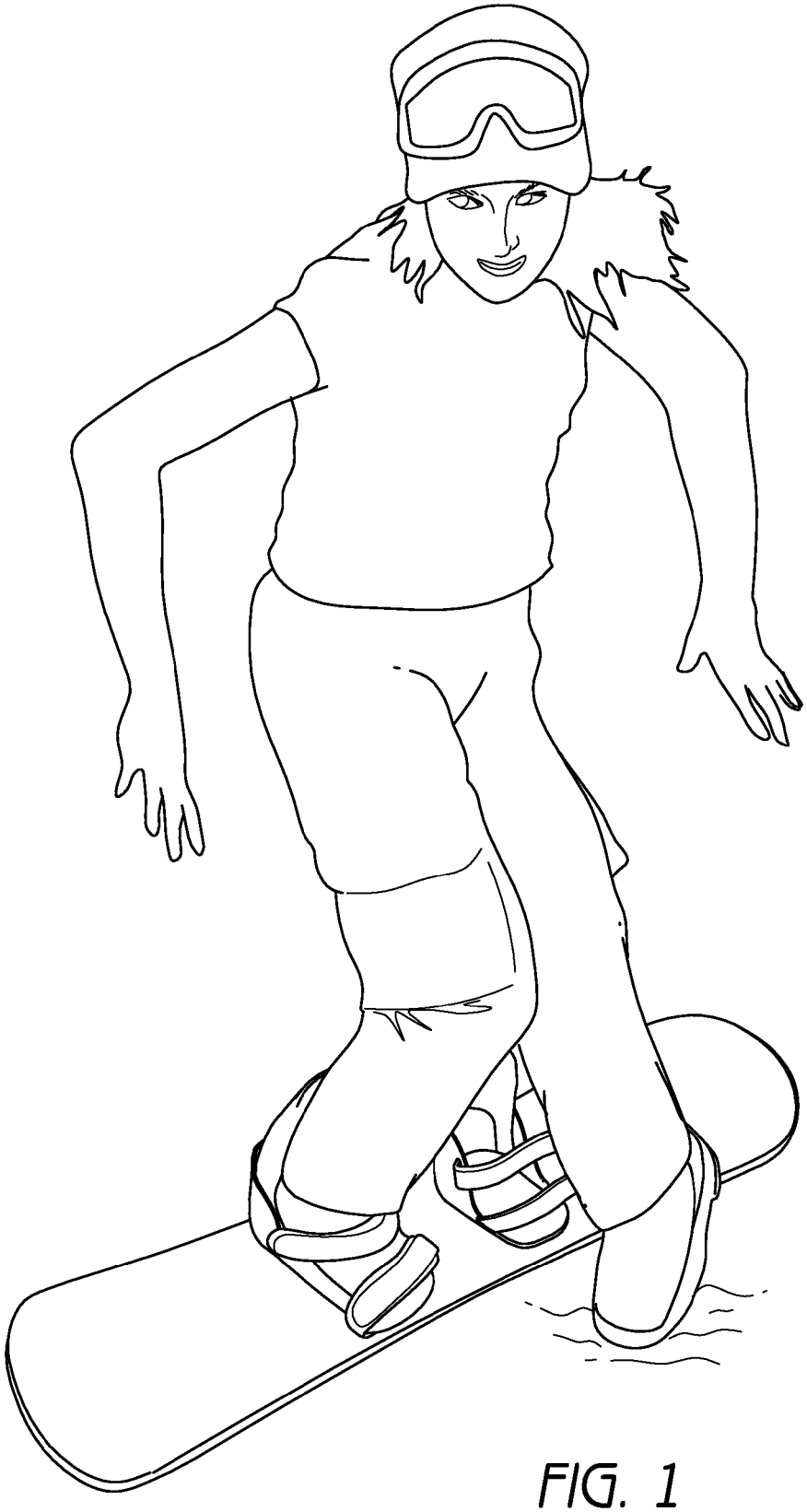
FIG. 1 is an image showing a prior art configuration in which a rider is unable to rapidly and repeatedly adjust the orientation of a front binding or foot relative to a snowboard.

Embodiments of the rotationally adjustable binding mounting system (also referred to herein as an adapter plate system or a releasable adapter plate assembly) disclosed herein can be used for a variety of boards, including without limitation, snowboards, skateboards, wake boards, surfboards, and other recreational use boards. Some embodiments are described herein in the context of using the adjustable binding mounting system for a snowboard, but all such embodiments are equally usable for other recreational boards, with or without modifications within the skill level of one of ordinary skill in the art. Some embodiments of the adjustable binding mounting system disclosed herein are configured to be mountable on at least 99% of all snowboards worldwide. For example, without limitation, some embodiments of the adapter plate assembly disclosed herein can be configured to work with at least the typical three bolt and/or four bolt insert patterns on snowboard decks. Additionally, embodiments of the mounting system disclosed herein can be configured to work with the BURTON EST SLIDE SYSTEM.

Some embodiments disclosed herein permit a user to adjust his or her stance on the board quickly and easily, thereby allowing users to spend more time enjoying the sport and less time adjusting their bindings, enhancing the board riding experience. Because adjusting the rotational position of the user's foot is so easy with the embodiments disclosed herein, the users can propel or kick the snowboard like a skateboard, for example, with the front foot pointing in the forward direction or approximately in the forward direction. The adapter plate assembly can enable a user to quickly change his or her stance and avoid the pigeon toe or duck walk stance when desired. This quick adjustability can also reduce the fatigue of a user by quickly and easily allowing the user to adjust his or her stance repeatedly throughout the day, and such adjustability can reduce ankle, knee, and hip torque and fatigue. Additionally, being able to adjust the rotational position of the front foot with some embodiments disclosed herein makes it easier to control the snowboard when pushing through lines and moving on the board with one foot removed, which can reduce falls, accidents, and collisions with other skiers or snowboarders.

Additionally, the quick and easy adjustability of some embodiments of the adjustable binding adapter plate assembly disclosed herein can be of great benefit to snowboard retail sales and rental shops, permitting quick, efficient, and easy rotational adjustment of the bindings to fit many desired angular foot positions for users. Thus, the adjustable binding adapter plate assembly can significantly reduce the waiting time and backlog of customers in a snowboard retail or rental shop, and can reduce the number of users who come back to the retail or rental shop for modifications to the rotational position of the bindings and/or for missing, stripped, and/or otherwise damaged hardware.

Additionally, another benefit of at least some embodiments of the adjustable binding adapter plate assembly for snowboards is that some embodiments of the adjustable binding system elevate the user's binding, hence, boot, above the top surface of the board, thereby potentially reducing toe and/or heal drag on the snow or other riding surface. Some embodiments of the rotationally adjustable binding adapter plate assembly disclosed herein can raise the user's bindings by approximately 0.75 inches above the top surface of the board. Some embodiments of the rotationally adjustable binding adapter plate assembly disclosed herein can raise the user's bindings by between approximately 0.5 inches and approximately 1.0 inch or more above the top surface of the board.

Figure 2:
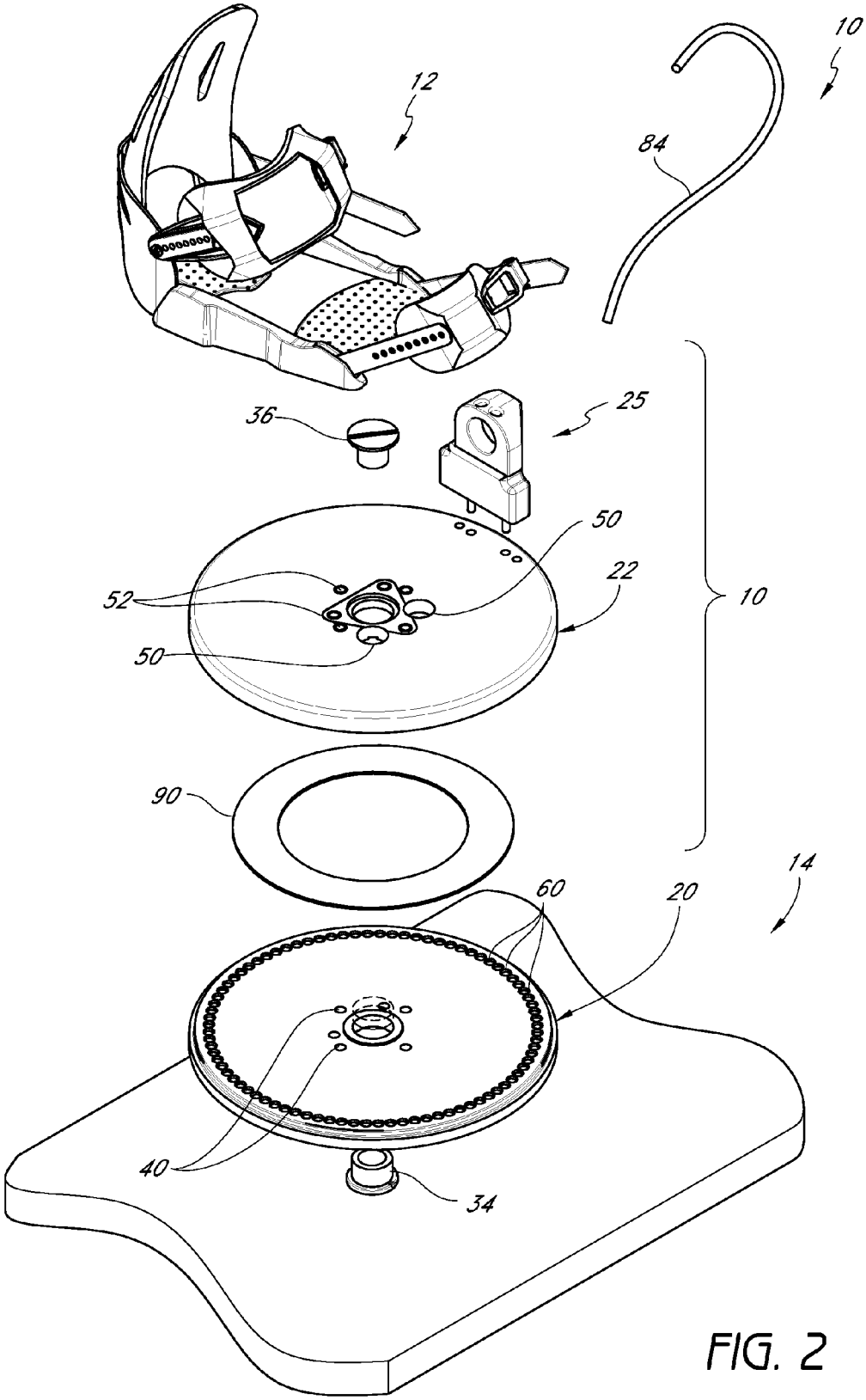
FIG. 2 is an exploded view of an embodiment of an adjustable adapter plate assembly that connects a binding to a snowboard, along with a non-limiting example of a binding that can be used with some of the adapter plate assembly embodiments disclosed herein.

FIG. 2 shows an exploded view of an embodiment of a releasable adapter plate assembly 10 that is arranged and configured in accordance with certain features, aspects and advantages of the present disclosure. Also shown is a non-limiting example of a binding 12 that can be used with some embodiments of the adapter plate assembly embodiments disclosed herein. Note that some of the details of the binding 12 have been omitted from one or more of the figures herein for clarity. With reference to FIG. 2, the releasable adapter plate assembly 10 can be positioned between the binding device 12 and a piece of sports equipment, for example but without limitation, a snowboard 14. In some configurations, the piece of sports equipment can be a wakeboard or any other sports equipment in which a foot is fixed in a particular rotational orientation during use.

The releasable adapter plate assembly 10 can comprise a base plate 20 (also referred to herein as a base plate, a first plate, a first member, or a first mounting member), a top plate 22 (also referred to herein as a second plate, a second member, or a second mounting member) and a locking mechanism 25 that can be used to secure the top plate 22 against substantial rotation relative to the base plate 20. The base plate 20 and the top plate 22 are capable of relative rotation when the locking mechanism is in an unlocked position. Accordingly, the top plate 22 can rotate relative to the base plate 20 between two or more rotational positions. As compared to some other binding adapter plate assemblies that may exist in the art, the adapter plate assembly embodiments disclosed herein have fewer parts, which can improve reliability and manufacturability while decreasing costs and weight.

With continued reference to FIG. 2, when the adapter plate assembly 10 is attached to a board (for example, the board 14), a bottom surface of the base plate 20 preferably will be in contact with a top surface of the board 14. The illustrated base plate 20 and top plate 22 can be generally disk-shaped and can have a diameter equal to approximately 9 inches. In some embodiments, the base plate 20 and top plate 22 can have a diameter ranging from approximately 4 inches or less to approximately 11 inches or more, or ranging from approximately 6 inches to approximately 9 inches, depending on the size of the board and size of the binding that the adapter plate assembly will be used with, among other factors.

In some embodiments, at least a portion of the base plate 20 can be generally circular in cross-section. The portion that can be generally circular in cross-section can be several inches or more in diameter. In some configurations, the generally circular cross-section can be approximately 7.6 inches, or, in some embodiments, can be from approximately 4 inches or less to approximately 11 inches or more. In some embodiments, the generally circular cross-section can be from approximately 6 inches to approximately 9 inches. Some embodiments of the base plate 20 should be large enough for mounting to stock mounting holes of the snowboard 14, yet small enough to not overhang edges of the board 14.

The illustrated base plate 20 can have a thickness of approximately 0.375 inch, but any suitable thickness can be used. The base plate 20 can be sufficiently thick for durability while being as thin as reasonable for reduced weight. More preferably, the generally circular cross-section can have a thickness of approximately 0.375 inch while the base plate 20 can have portions with greater or lesser thickness as desired. For example, in some embodiments, the adapter plate assembly 10 can be configured to be slanted in a forward or aft direction and/or a lateral direction such that a binding mounted to the adapter plate assembly 10 can be slanted in a forward or after direction, and/or a lateral direction. In some embodiments, for example, the adapter plate assembly 10 can be configured to slant or angle one or more of the bindings attached thereto laterally inwardly, or one inwardly and the other outwardly.

Figure 5:
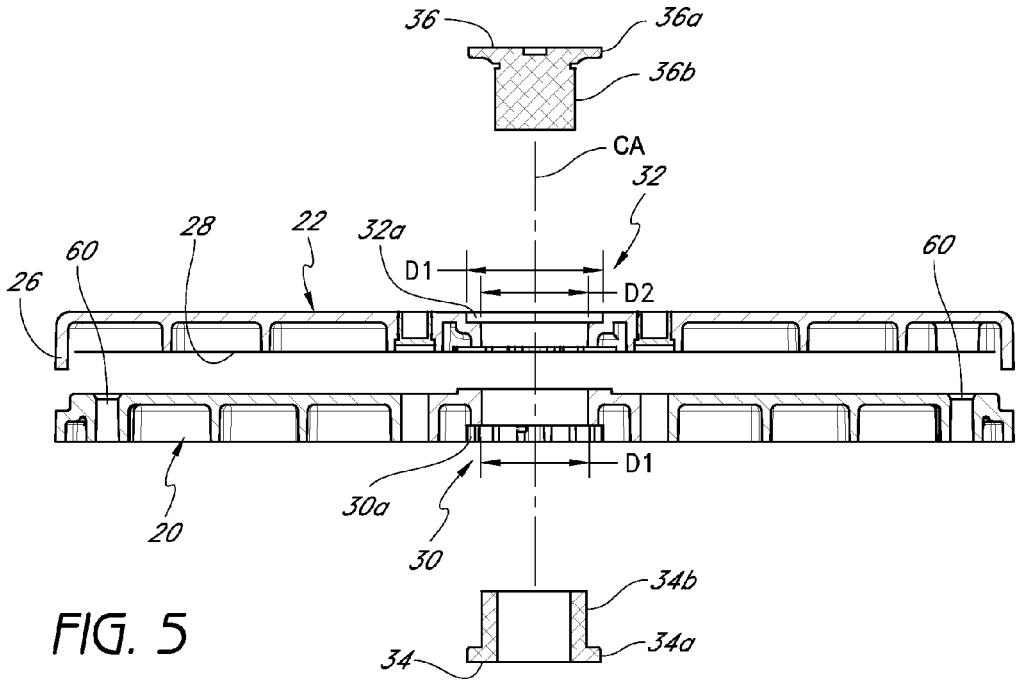
FIG. 5 is a section view of the embodiment of the adjustable adapter plate assembly shown in FIG. 2, taken along the line 5-5 in FIG. 4.

With continued reference to FIG. 2, as mentioned, the top plate 22 can have at least a portion that can be generally cylindrical in shape. A periphery of the top plate 22 can also be generally cylindrical. With reference to FIG. 5, the top plate 22 can comprise an upper surface 24 and at least one side wall 26 that generally define a generally cylindrical recess 28. The top plate 22 and recess 28 can be formed in any suitable manner, including through injection molding, casting, machining, etc. The recess 28 can have a depth that is generally less than the thickness of the portion of the base plate 20 that is generally circular in cross-section. In this manner, the recess 28 can be configured to receive at least a portion of the base plate 20, while maintaining the side wall 26 spaced apart from or out of contact with the board 14 or any other underlying component of the adapter plate assembly 10. Additionally, one or more recesses can be formed in either of the top plate 22 and the base plate 20 to maximize strength while reducing weight, and to obtain the optimal thickness of the plates 20, 22 or increase the thickness thereof at a reduced weight.

In some arrangements, the top plate 22 can be generally disk-shaped with a diameter of about 7.86 inches. The inner surface of the side wall 26 can have a diameter of about 7.63 inches, which can be similar to or slightly larger than the corresponding outer diameter of the base plate 20. The illustrated top plate 22 can comprise a thickness of approximately 0.3 inches but other thicknesses can be used.

With reference still to FIG. 5, the base plate 20 can have a center hole 30. Similarly, in some embodiments, the top plate 22 can have a corresponding center hole 32 aligned with the center hole 30 of the base plate 20. The two center holes 30, 32 can have a center axis (designated CA on FIG. 5) that can extend through both the base plate 20 and the top plate 22 and about which at least one of the base plate 20 and the top plate 22 rotates.

The center hole 30 of the base plate 20 can be configured to receive therein a bottom threaded fastener member 34, such as but without limitation a female threaded collar member. Similarly, the center hole 32 of the top plate 22 can be configured to receive a top threaded fastener member 36, such as but without limitation a male threaded bolt member. The bottom threaded fastener member 34 can have a hollow bore partially or fully extending therethrough, which can be threaded. The bottom threaded fastener member 34 can have a lipped or flanged portion 34*a* that has a diameter that is greater than a body portion 34*b* of the bottom threaded fastener member 34. Similarly, the top threaded fastener member 36 can have a lipped or flanged portion 36*a* that has a diameter that is greater than a body portion 36*b* of the top threaded fastener member 36. A diameter or cross-sectional size of the flanged portion 34*a*, 36*a* of each of the fastener members 34, 36 can be approximately 20 percent greater than, or from approximately 15 percent or less to approximately 30 percent or more greater than a diameter or cross-sectional size of the body portion 34*b*, 36*b* of each of the fastener members 34, 36. Coupling the top plate 22 to the base plate 20 using a fastener that is coaxial with the centerline axis of the top plate 22 and base plate 20 can improve the smooth operation and rotational performance of the adapter assembly 10 when the adapter assembly 10 is being rotationally adjusted or moved.

In some embodiments, the adapter plate assembly 10 can be configured such that at least one of the bottom threaded fastener member 34 and the top threaded fastener member 36 can be prevented from rotating relative to the base plate 20 and/or top plate 22. This can, inter alia, facilitate tightening of the top threaded fastener member 36 relative to the bottom threaded fastener member 34, or vice versa. For example, in some embodiments, the lipped or flanged portion 34*a* of the bottom threaded fastener member 34 can have one or more flat surfaces, slots, channels, protrusions or other similar features formed therein or thereon configured to be engaged by one or more complementary features in the center hole 30 of the base plate 20 or in a counterbore or recess axially aligned with the center hole 30. Further, the top threaded fastener member 36 can have a slot, recess, or opening configured to receive a tool such as a flathead, phillips, torx, or other screwdriver, an allen wrench, or other suitable tool.

Additionally, in some embodiments, at least one of the bottom threaded fastener member 34 and the top threaded fastener member 36 can have features to prevent or inhibit the bottom threaded fastener member 34 and the top threaded fastener member 36 from inadvertently disengaging from one another during use of the assembly 10. For example, in some embodiments, at least one of the bottom threaded fastener member 34 and the top threaded fastener member 36 can have thread locking substances or features added to the threads thereof. In some embodiments, the threads can be knurled.

One or both of the openings 30, 32 can have a recess formed axially aligned therewith and adjacent thereto. For example, the center hole 32 of the top plate 22 can be counterbored such that the center hole 30 has a first diameter D1 and a second diameter D2 smaller than the first diameter. In some embodiments, the section with the larger diameter, i.e., the counterbore portion 32*a*, can be closest to the top side of the top plate 22, and can be configured to receive the flange portion 36*a* of the fastener 36 therein for flush mounting of the fastener 36 relative to the top surface of the top plate 22. For similar reasons, as mentioned above, the center hole 30 of the bottom plate 20 can also be recessed or countersunk such that the center hole 32 has a first diameter D1 and a recess 30*a* that extends beyond the first diameter D1. With respect to the top plate 22, the smaller diameter portion can be closest to the bottom side of the top plate 22.

The bottom threaded fastener member 34 can have an inside region that comprises a threaded section. In some embodiments, the axial length of the bottom threaded fastener member 34 can be equal to or less than the thickness of the base plate 20, and the axial length of the body portion 34*b* of the bottom threaded fastener member 34 can be approximately equal to or slightly less than the axial length of the first diameter D1 portion of the bottom plate 20. In some embodiments, the axial length of the bottom threaded fastener member 34 can be greater than the thickness of the base plate 20 but less than the combined thickness of the base plate 20 and top plate 22 in an assembled state. Similarly, the axial length of the body portion 34*b* of the bottom threaded fastener member 34 can be greater than the axial length of the first diameter D1 portion of the bottom plate 30. The bottom threaded fastener member 34 can fit within the center hole 30 and can have a head portion that is received within the counterbore portion 30*a* of the center hole 30.

Similarly, the axial length of some embodiments of the top threaded fastener member 36 can be equal to or less than the thickness of the top plate 22, and the axial length of the body portion 34*b* of the bottom threaded fastener member 34 can be approximately equal to or slightly less than the axial length of the first diameter D1 portion of the top plate 22. The axial length of some embodiments of the top threaded fastener member 36 can be greater than the thickness of the top plate 22 but less than the combined thickness of the base plate 20 and top plate 22 in an assembled state. Similarly, the axial length of the body portion 34*b* of the bottom threaded fastener member 34 can be approximately equal to or slightly less than the axial length of the first diameter D1 portion of the top plate 22.

The body portion 36*b* of the top threaded fastener member 36 can be threaded on an outside surface thereof, and can be configured to engage threads that can be formed on an inside surface of the bottom threaded fastener member 34. The thickness of the top threaded fastener member 36 at the first diameter can be equal to or less than the thickness of the center hole 32 of the top plate 22 with the first, larger diameter. In other words, the top threaded fastener member 36 can be received within the center hole 32 of the top plate 22 and can have a head portion that can be received within the counterbore portion of the center hole 22.

The top threaded fastener member 36 and the bottom threaded fastener member 34 can be threaded together to couple the top plate 22 and the base plate 20. As mentioned, a portion of the head of the top threaded fastener member 36 and a portion of the head of the bottom threaded fastener member 34 can have patterns, indentations, or other markings that could engage a tool, aiding in threadably engaging the top threaded fastener member 36 to the bottom threaded fastener member 34. The bottom threaded fastener member 34 and the top threaded fastener member 36 can be made out of a variety of materials including but not limited to steel, aluminum, and other metals, plastics, and similar materials.

Figure 8:
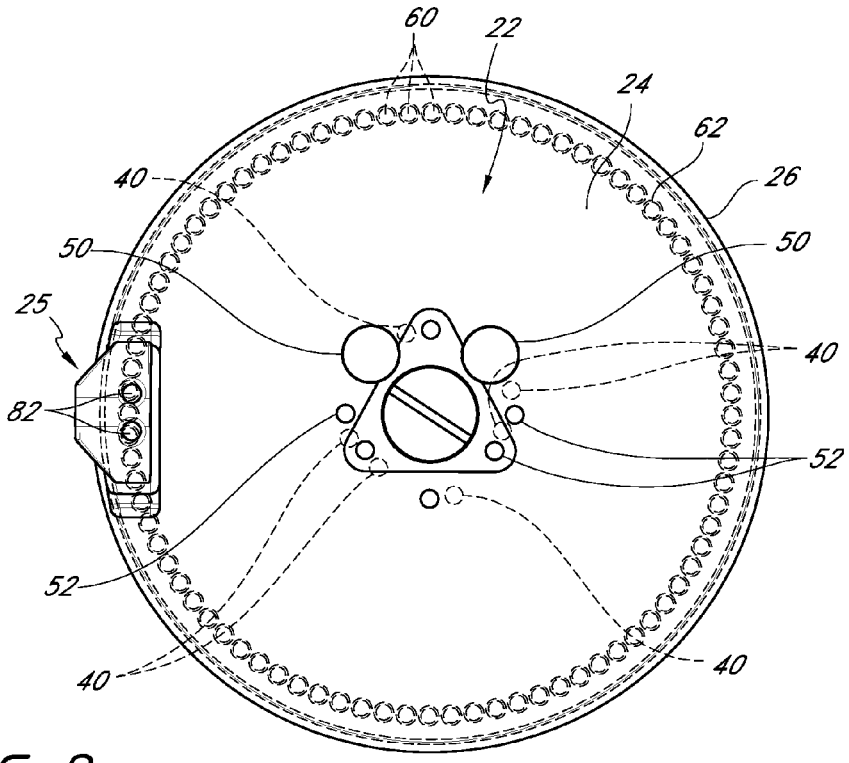
FIG. 8 is a top view of the embodiment of the adjustable adapter plate assembly shown in FIG. 2, with certain portions of the assembly shown in hidden lines.
Figure 11:
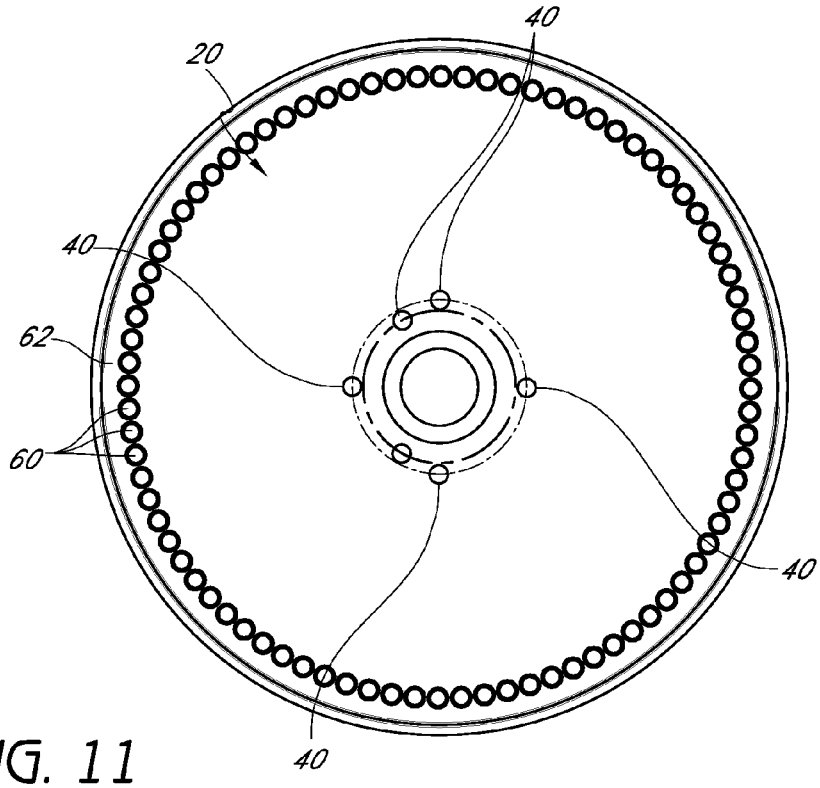
FIG. 11 is a top view of a bottom plate of the embodiment of the adjustable adapter plate assembly shown in FIG. 2.

With reference to FIGS. 8 and 11, the base plate 20 can have a plurality of mounting holes or openings 40, which can have any desired shape, including ovular or slotted, round, or otherwise to allow for lateral adjustability of the base plate 20 relative to the board or fasteners in the board. The mounting holes 40 can be used to secure the base plate 20 to a board 14 or other riding device. For example, bolts can be advanced through one or more of the mounting holes 40 and thread into inserts or female fasteners in the board. The pattern of the mounting holes 40 (e.g., the spacing and sizing for the mounting holes 40) can depend on and be dictated by the insert or fastener pattern on the board 14 or other riding device to which it is attached. Again, in some embodiments, the pattern of the mounting holes 40 can be configured to optimize the adapter plate assembly 10 for use with the widest range of boards possible. In other words, the mounting holes 40 can be positioned so as to be universal in nature, to work with any fastener or mounting pattern of boards within the respective industry. In some embodiments, with reference to FIGS. 8 and 11, the mounting holes 40 can comprise two paired sets of holes and three separated and spaced holes. This mounting hole pattern advantageously has been found to allow the adapter plate assembly 10 to be mounted to at least a majority of snowboards 14 currently being manufactured.

The mounting holes 40 can be through holes with a countersink on the top side. The countersink can allow the head of any threaded fastener to be recessed into the base plate such that the threaded fasteners will not significantly interfere with relatively smooth rotation of the top plate 22 relative to the base plate 20 when the rotational position of the adapter plate assembly 10 is being adjusted.

Figure 7:
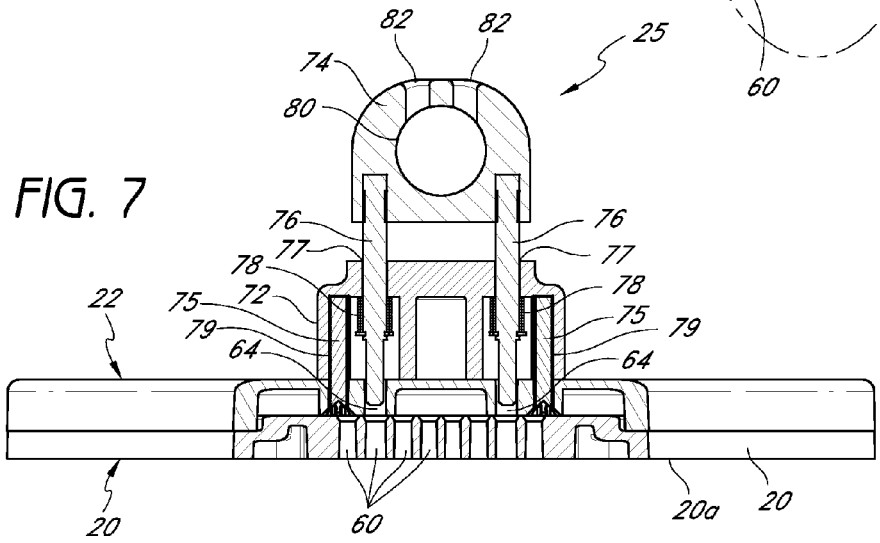
FIG. 7 is a section view of the embodiment of the adjustable adapter plate assembly shown in FIG. 2, showing the locking mechanism in a second or disengaged position.

With reference to FIGS. 2 and 7, the top plate 22 can have one or more access holes 50 to access the mounting holes 40 on the base plate 20. The access hole or holes 50 can be sized and configured to allow passage of the fasteners used to secure the base plate 20 to the board 14 as well as the tool or tools used to tighten such fasteners through the mounting holes 40 into the board. In some embodiments, the top plate 22 can be rotated to rotate the access hole or holes 50 to a position corresponding to each of the mounting holes 40 such that fasteners can be advanced through the mounting holes 40 and into the board without removal of the top plate 22 from the base plate 20. For example, the top plate 22 can be rotated relative to the base plate 20, which results in the access hole 50 passing over each of the mounting holes 40.

In some embodiments, the access hole or holes 50 can permit a user to mount the entire adapter assembly 10 to the board as one unit. This can save time for the user and prevent the incorrect assembly of components and loss of parts that may otherwise occur during the on the board mounting process. Further, in some embodiments of the adapter assembly 10, any of the fasteners used to mount the adapter assembly 10 to the recreational board can be adjusted and tightened through the one or more access holes 50 without disassembling any portion of the adapter assembly 10.

The distance from the center axis CA to the section of the access hole 50 farthest from the center axis CA can be equal to or greater than the distance from the center axis CA to the outside diameter of the mounting holes 40 farthest from the center axis CA. In addition, the distance from the center axis to the section of the access hole 50 closest to the center axis can be equal to or less than the distance from the center of the base plate 20 to the inside diameter of the mounting holes 40 closest to the center axis CA. In some embodiments, the access hole 50 can be generally round but other shapes can be used.

In some configurations, a plurality of access holes 50 can be provided. Some embodiments of the adapter plate assembly 10 can have two access holes 50 located approximately 180 degrees apart on the top plate 22 relative to the center axis CA. Some embodiments of the adapter plate assembly 10 can have three or four access holes that are positioned to align simultaneously with three or four of the mounting holes 40. Any of the access holes 50 can have a different shape or diameter, or can be positioned at different distances from the center CA of the top plate 22.

The top plate 22 also can have a plurality of top plate mounting holes or openings 52 which can have any desired shape, including ovular or slotted, round, or otherwise to allow for lateral adjustability of the binding relative to the top plate 22. The mounting holes or openings 52 can be used to attach or otherwise secure the binding device 12 or other foot securing device (collectively referred to herein as the binding device or binding device 12) to the top plate 22. In some embodiments, the mounting holes 52 can be threaded or can have sliding threaded fasteners (such as, but without limitation, nuts) and can be configured such that bolts passing through the binding device can be threaded into the mounting holes 52. The pattern of the top plate mounting holes 52 can depend on and be dictated by the corresponding hole pattern in the binding device 12 which is to be secured to the adapter plate assembly 10. Preferably, however, as with the mounting holes 40 of the base plate 20, the mounting holes 52 are positioned to be somewhat universal in nature. In other words, the illustrated mounting holes 52 comprise two paired sets of holes and three separated and spaced holes. This mounting hole pattern advantageously has been found to allow the adapter plate assembly 10 to be mounted to at least a majority of binding devices 12 currently being manufactured.

The top plate mounting holes 52 can go through the depth of the top plate 22 and can have a threaded section or can receive nuts or other internally threaded members. In some embodiments, however, the mounting holes 52 can only extend partially through the top plate 22 and can be blind holes with a threaded portion. The diameter and thread pitch of the top plate mounting holes 52 can depend on the mounting hardware associated with the binding device 12 or other foot securing device, and can be configured to work with a variety of such binding devices.

With reference to FIGS. 8 and 11, the base plate 20 can have a plurality of openings or recesses 60. Some embodiments of the base plate 20 can have at least two pairs of recesses 60, wherein each recess 60 of the two or more pairs of recesses 60 is equally spaced from the other recess 60 of the two or more pairs of recesses 60. In some embodiments, the base plate 60 can have a continuous array of recesses 60, each of the recesses 60 being equally spaced apart from one another.

The top plate 22 can substantially cover the recesses 60 to prevent or inhibit water, snow, ice, dirt, or debris from getting into the recesses 60 and interfering with the operation of the adapter plate assembly 10. In some embodiments, the recesses 60 can be through holes but, in some embodiments, can be blind holes extending only through a portion of the base plate 20 and having closed ends. Though not required or present in all embodiments, the recesses 60 can be rounded, chamfered, or countersunk at the top edge thereof to facilitate the insertion of the locking device, as will be described in greater detail. Therefore, in some embodiments, the recesses 60 can comprise blind holes that are rounded, chamfered, or countersunk at the top edge thereof.

In some embodiments, the recesses can be sized and positioned such that approximately 90 recesses 60 are formed in the base plate 20, having approximately 4 degrees of separation therebetween. In this configuration, a user can adjust his or her binding to any of 90 rotational positions on the board, each position being separated by approximately 4 degrees. In some embodiments, the recesses can be sized and positioned such that approximately 72 or less recesses 60 are formed in the base plate 20, having approximately 5 degrees or more of separation therebetween. In this configuration, a user can adjust his or her binding to any of 72 or fewer rotational positions on the board, each position being separated by approximately 5 degrees or more. In some embodiments, the recesses can be sized and positioned such that approximately 120 or more recesses 60 are formed in the base plate 20, having approximately 3 degrees or less of separation therebetween. In this configuration, a user can adjust his or her binding to any of 120 or more rotational positions on the board, each position being separated by approximately 3 degrees or less.

The recesses 60 can be arranged in a radial pattern so as to generally define a circular ring 62 that encircles at least a portion of the base plate so as to be concentric about the center of the base plate 20. In this configuration, the centers of the recesses 60 will be approximately equidistant from the center axis CA of the base plate 20. More preferably, the centers of the recesses 60 can be closer to an outer diameter of the base plate than to the center axis CA. In some embodiments, the diameter of circular ring 62 passing through the recesses 60 can be approximately 8 inches, or approximately from 0.25 inch to 2 inches or more smaller than the diameter of the top plate 22 such that each of the openings 60 are positioned approximately ½ inch from the edge 26 of the top plate 22.

The number of recesses 60 in the illustrated ring 62 can vary from four recesses to several dozen recesses, depending upon the level of adjustability desired. In some embodiments, the angular spacing of the recesses 60 can be approximately 5 degrees, although this measurement can vary. The ring of recesses 60 need not circumscribe the entire base plate 20 but, in the illustrated configuration, the recesses 60 forming the ring 62 are spaced substantially equally and generally circumscribe the entire base plate 20. In some embodiments, at least one of the top plate and the base plate can comprise detents or other indexing features configured to assist in the alignment of insertion members 76 supported by the locking mechanism 25 with the openings 60 formed in the base plate 20.

The top plate 22 can also comprise at least one through hole 64 (two being shown) near the outer diameter of the top plate 22. Some embodiments can have three through holes 64 equally spaced apart from one another. The radius to the through holes 64, as measured from the center axis CA, should be substantially equal to the radius defined by the ring 62 of recesses 60 as measured from the center axis CA to the center of the recesses 60. The angular separation of the two holes 64 can be a multiple of the angular displacement of adjacent recesses 60 in the ring 62 of recesses 60. For example, in the illustrated embodiment, the two through holes 64 can be configured to align with two recesses 60 that are separated by four recesses 60. The diameter of the through holes 64 can be substantially similar to the diameter to a recess 60.

Figure 3A:
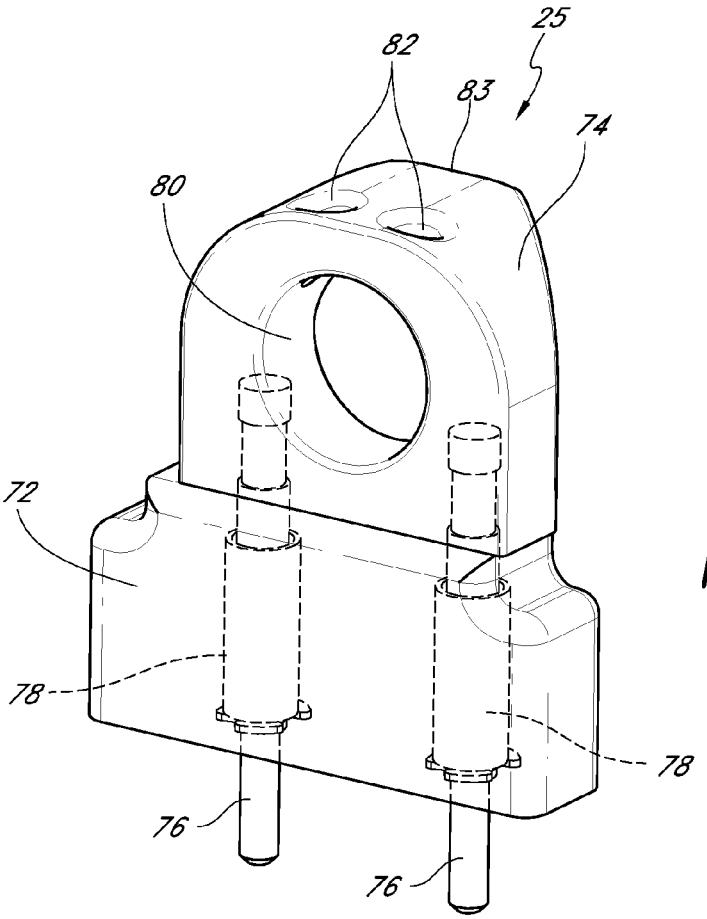
FIG. 3A is a perspective view of an embodiment of a locking mechanism that can be used with the embodiment of the adapter plate assembly shown in FIG. 2.
Figure 3B:
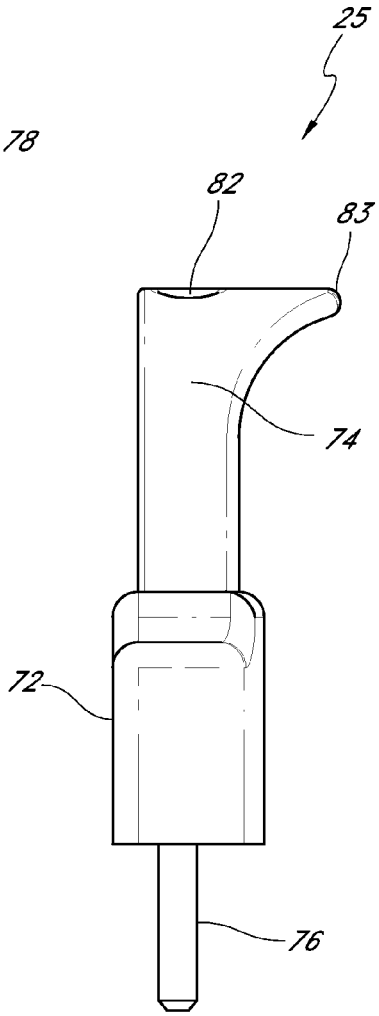
FIG. 3B is a side view of the locking mechanism embodiment shown in FIG. 3A.
Figure 4:
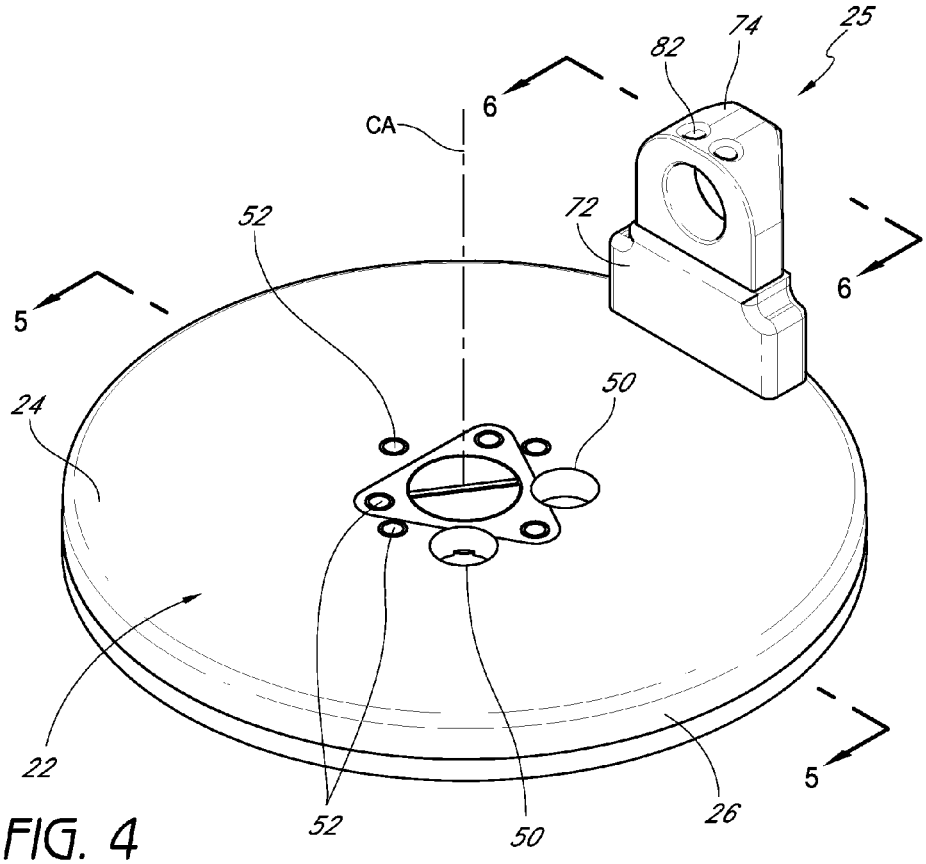
FIG. 4 is a perspective view of the embodiment of the adjustable adapter plate assembly shown in FIG. 2.
Figure 6A:
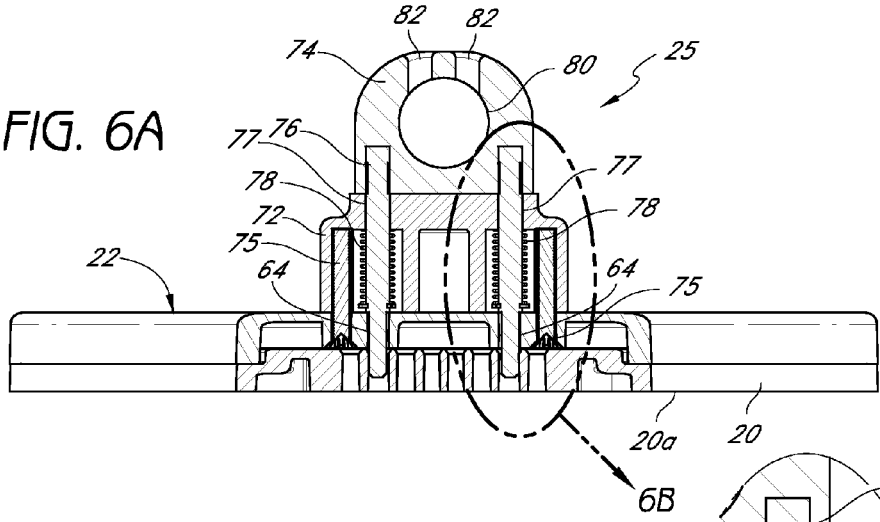
FIG. 6A is a section view of the embodiment of the adjustable adapter plate assembly shown in FIG. 2, taken along the line 6-6 in FIG. 4, showing the locking mechanism in a first or engaged position.
Figure 9:
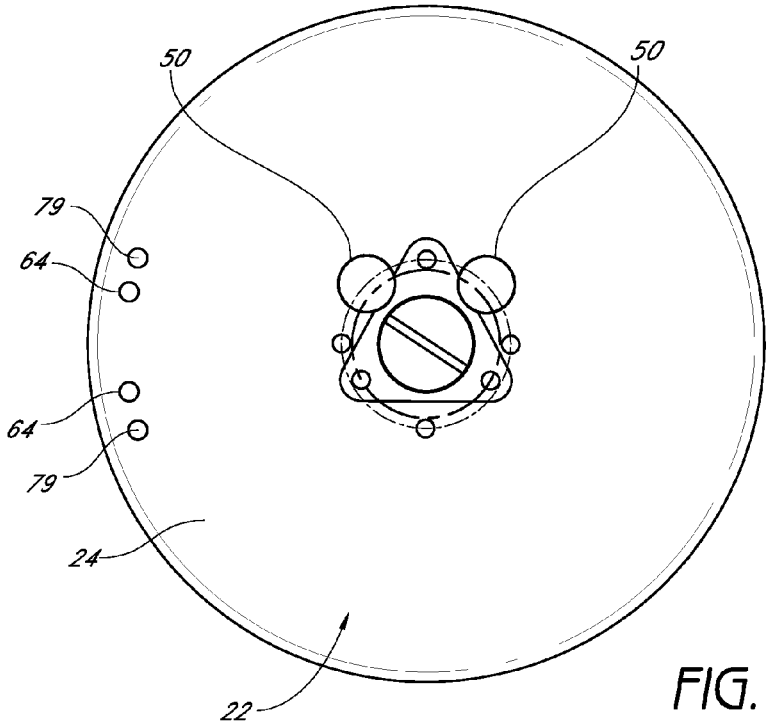
FIG. 9 is a top view of a top plate of the embodiment of the adjustable adapter plate assembly shown in FIG. 2.
Figure 10:
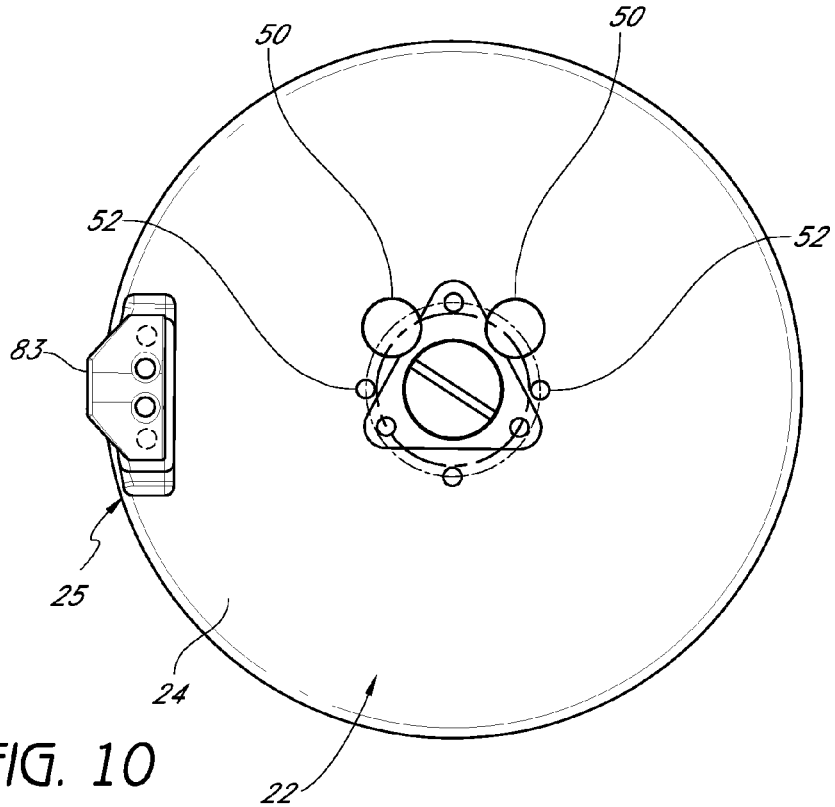
FIG. 10 is a top view of the top plate of the embodiment of the adjustable adapter plate assembly shown in FIG. 2, with the locking mechanism assembled to the top plate.
Figure 13:
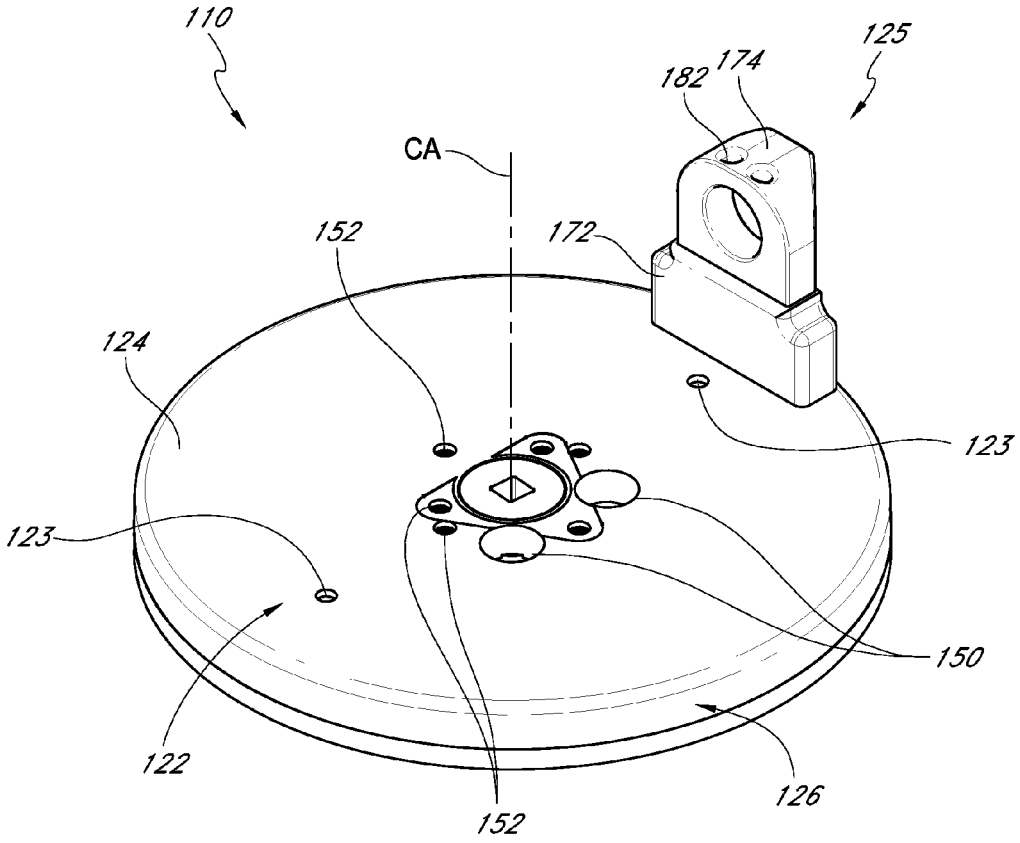
FIG. 13 is a perspective view of another embodiment of an adapter plate assembly.

With reference to FIG. 3, an embodiment of a locking mechanism 25 is illustrated. With reference to FIGS. 6A, 7, and 13, the locking mechanism 25 can be mounted to the top plate 22 by any suitable means, including being mounted using screws, anchors, adhesives, welding, or by using other similar fasteners or techniques. For example but without limitation, with reference to FIGS. 6A and 9, screws 75 can be advanced through openings 79 formed in the top plate 22. Any other suitable method presently known or later developed for attachment can be used. In the illustrated embodiment, the locking mechanism 25 can comprise a body portion 72, a pull member 74, a pair of posts or insertion members 76 and corresponding springs 78. The pull member 74 can have one or more finger holes 80 and/or one or more lanyard or strap holes 82. In some embodiments, the body portion 72 can have two substantially parallel holes 77 arranged in a substantially vertical direction. The holes 77 can be coaxially aligned with the through holes 64. At least a portion of each of the insertion members 76 can be received within these generally vertical holes 77. The holes 77 can be sized and configured to create a substantially fluid and debris tight seal around the insertion members 76. Having two or more insertion members 76 increases the robustness of the design by doubling the shear strength of the locking mechanism, thereby doubling the strength of the rotational connection between the base plate and the top plate as compared to a design having only one insertion member or pin. Having two or more insertion members 76 also increases the precision of the alignment between the locking mechanism 25 and the base plate 20. Further, the pair of insertion members 76 provide redundancy so that, if one of the insertion members 76 fails, the adapter assembly 10 can still function at least until the failed insertion member 76 can be fixed.

In some embodiments, the body portion 72 can have seals supported in the openings 77 to create a substantially fluid and debris tight seal around the insertion members 76. Additionally, in some embodiments, the locking mechanism 25 can have detents, depressions, or other features which bias the insertion members 76 in the downward position in which the insertion members 76 are substantially engaged with the openings 60 or which inhibit the insertion members 76 from easily and/or inadvertently disengaging from the openings 60. In some embodiments, the locking mechanism 25 can have a latch, pin, or other similar or suitable feature that can be used to secure the locking mechanism 25 in either or both of the open position (wherein the insertion members 76 are axially spaced apart from the openings 60, as illustrated in FIG. 6A, also referred to herein as a first position) or in the closed position (wherein the insertion members 76 are axially overlapped or engaged with the openings 60, as illustrated in FIG. 7, also referred to herein as a second position). For example, in some embodiments, the pull member 74 could support a latch that snaps into or otherwise is engageable with the body portion 72 of the locking mechanism 25, or a locking mechanism that engages the insertion members 76 to hold them in either an upward, first position wherein the top plate 22 can be rotated relative to the base plate 20, or in an engaged, second position wherein the top plate 22 is rotationally fixed to the base plate 20.

The pull member 74 can be removably or non-removably coupled with the top of the insertion members 76. In some embodiments, the pull member 74 and the insertion members 76 can be integrally formed. In some embodiments, the pull member 74 can be formed around the insertion members 76 in a molding process. Alternatively, insertion member or members 74 can be threadedly engaged with openings in the pull member 74, adhered to openings in the pull member 74, or otherwise coupled with the pull member 74 by any suitable fasteners or means.

In some embodiments, springs 78 can be inserted into the generally vertical holes of the body portion 72 so that the springs bias the insertion members 77 in a direction away from the pull member 74, i.e., into the recesses 60. In this configuration, the springs 78 can bias the insertion members 76 to engage with the recesses 60, thereby also biasing the pull member 74 in a downward direction.

Figure 6B:
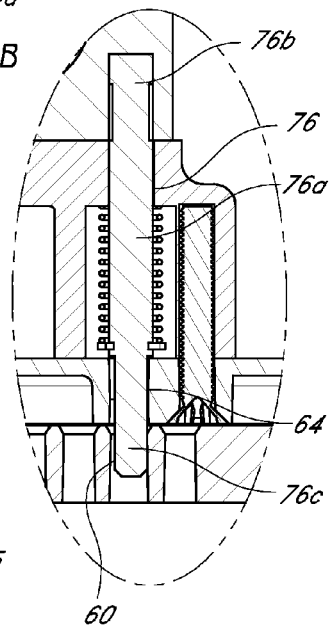
FIG. 6B is an enlarged portion of the section view of FIG. 6A.

In some embodiments, with reference to FIG. 6B, the insertion member 76 can have a body portion 76*a*, a first end portion 76*b*, and a second end portion 76*c*. The second end portion 76*c* can have a length approximately equal to or slightly less than the combined thickness of the top and base plates 22, 20, respectively, so that that second end portion 76*c* does not extend past the bottom surface 20*a* of the base plate 20 when the insertion member 76 is in the fully inserted state, as shown in FIGS. 6A and 6B. The diameter or cross-sectional size of the second end portion 76*c* of the insertion member 76 can be slightly less than the diameter of the openings 60 formed in the base plate 20 or the openings 64 formed in the top plate 22, so that the second end portion 76*c* of the insertion member 76 can smoothly and easily extend into the openings 60, 64 when the pull member 74 is released. In some embodiments, the user may rotate the top plate 22 slightly relative to the base plate 20 in one or both rotational directions to align the openings 60, 64 to receive the insertion member 76.

In some embodiments, the diameter of the body portion 76*a* of the insertion member 76 can be greater than the diameter of the second end portion 76*b* of the insertion member. Additionally, the diameter of the body portion 76*a* can be greater than the diameter of the openings 64. In this configuration, the body portion 76*a* can provide a positive stop to prevent the body portion from extending into the openings 64 and, therefore, limit the depth to which the insertion member 76 advances into the openings 60, 64.

The springs can be metal springs, made from spring steel, or can be elastomeric bands or springs that urge the insertion members 76 into engagement with the recesses 60. Other methods also can be used to urge the insertion members 76 in a downward direction.

In some embodiments, the locking mechanism 25 can have a protective sleeve or other barrier supported thereon to prevent or reduce the likelihood of snow, ice, debris, or any other objects or substances affecting the functionality of the pull member 74. For example, a sleeve or sheath can be positioned around all or a portion of the body portion 72 to prevent snow, ice, debris, or any other objects or substances from entering the openings 77 formed in the body portion. A lubricant such as a silicone lubricant can be used within the latch device 40 to improve the smooth movement and function of the pull member 74, and to reduce the likelihood of liquids, such as water, from substantially interfering with operation of the locking mechanism 25. A lubricant can also be used to reduce friction between other moving parts, such as the bottom plate 20 and the top plate 22.

Some embodiments of the illustrated pull member 74 can comprise one or more finger holes 80. The finger hole 80 can have an aperture therethrough into which a person can insert a finger, a gloved finger, or a portion thereof to pull the pull member 74 in an upward direction against the bias of the springs 78. In some embodiments, the pull member 74 can have a continuous outer shape or cross-section, but have one or more protuberances, tabs, flanges or other features to improve the gripability of the pull member 74.

Additionally, the pull member 74 can comprise one or more holes 82 near the top of the pull member 74. The hole or holes 82 can receive and support an end portion of a strap 84 (which can be a cord, leash, lanyard, coil, cord, or any other suitable tensile member), which can be used to pull the pull member 74 in an upward direction against the bias of the springs 78 so that the user does not have to reach down to the pull member 74 to disengage the insertion members 76 from the recesses 60 in the base plate 20 to adjust the rotational orientation of the adapter plate system 10 and, hence, his or her foot. The lanyard 82 can be advanced through the lanyard hole or holes 82 and secured thereto.

In some embodiments, the opening 80 can be positioned in the center between the two insertion members 76 to approximately equally distribute the pull force onto each of the two insertion members 76 and prevent or reduce the likelihood of bending the insertion members 76 and increase the smooth movement and operation of the insertion members 76. Similarly, in some embodiments, a single lanyard hole 82 can be positioned in the center between the two insertion members 76 to approximately equally distribute the pull force onto each of the two insertion members 76. If two lanyard holes 82 are formed in the pull member 74, the two lanyard holes 82 can be positioned so as to be symmetrical to the center plane or center line between the two insertion members 76 so as to approximately equally distribute the pull force onto each of the two insertion members 76 and to permit the lanyard to be positioned at the approximate center of the pull member 74. Additionally, in some embodiments, each of the insertion members 76 can have rounded, tapered, or chamfered end portions to improve the insertability and/or alignability of the insertion members 76 into the recesses 60.

With reference to FIGS. 3A, 3B, 10 and 13, the profile of the pull member 74 can also be designed to have a lip or a flange 83 under which a person can put his or her finger or gloved finger, and move the pull member 74 in an upward direction. The lip or flange 83 can be a straight projection (not illustrated) or can have a curved lower surface. The pull member 74 also can comprise other shapes or features.

In some embodiments, though not required, a bearing plate 90 or other member (also referred to herein as a third member) can be positioned between the base plate 20 and the top plate 22. The bearing plate 90 can be used to reduce the frictional forces between the top plate 22 and the base plate 20. The bearing plate 90 can be generally circular in shape and can have a relatively low profile. In some embodiments, the inside diameter of the bearing plate 90 can be further from the center of the base plate 20 than the outside diameter of the mounting holes 40 furthest from the center axis CA, or otherwise be configured such that the bearing plate 90 does not obstruct the passage of threaded fasteners through any of the mounting holes. For example (not illustrated), the base plate 90 can have openings, slots, channels, cutouts, or other suitable features therein aligned with the mounting holes 40 and/or mounting holes 52.

The bearing plate 90 can be made of a low friction material, such as Teflon or any suitable material with enhanced frictional properties. The bearing plate 90 can be positioned in an annular channel formed in at least one of the base plate 20 and the top plate 22 to reduce the likelihood of migration of the bearing plate 90 during use. In some embodiments, the bearing plate 90 can be coupled for rotation with one of the base plate 20 and the top plate 22. For example, the bearing plate 90 can be adhered to or embedded within the base plate 20 or the top plate 22. In some embodiments, all or a portion of one or more of the base plate 20 and the top plate 22 can be constructed of a lubricious material instead of using the bearing plate 90. In other embodiments, the bearing plate 90 can be omitted. In such embodiments, the top plate 22 and bottom plate 20, or portions thereof, can be in direct contact.

Many of the components of the adapter plate assembly disclosed herein, including but not limited to the base plate and the top plate can be formed from metallic or polymeric materials. In some embodiments, such components can be formed from high-impact glass filled nylon, e.g., a 12% glass filled nylon 6 material. In some embodiments, the top plate 22, or any other component disclosed herein can be formed from aluminum. Additionally, any of the adapter plate assembly components can be made from stainless steel and/or aluminum, or a combination of such metals and plastic. The materials comprising the adapter plate assembly can be chosen and/or enhanced so as to reduce the friction of one or more mating or contacting surfaces to improve the ability of the adapter plate assembly to rotate during the adjustment of the adapter plate assembly. Many of the components comprising the adapter plate assembly can be formed by plastic injection molding or other suitable means. In some embodiments, the adapter plate assembly can weigh approximately 1.4 pounds each.

The adapter plate assembly 10 can be assembled by any suitable method. In some embodiments, the bottom threaded fastener member 34 can be inserted up through the center hole 30 of the base plate 20. The top threaded fastener member 36 can be inserted down through the center hole 32 of the top plate 22, such that the top threaded fastener member 36 threadably engages the bottom threaded fastener member 34. In some embodiments, the top threaded fastener member 36 and the bottom threaded fastener member 34 can be sufficiently engaged to remove excess axial movement between the top plate 22 and the base plate 20, while still permitting the top plate 22 to rotate relative to the base plate 20. In some embodiments, one of the top threaded fastener member 36 and the bottom threaded fastener member 34 (or any other similar or suitable fastener or threaded feature) can be integrated into the respective top plate 22 or base plate 20. In this configuration, the other of the top threaded fastener member 36 and bottom threaded fastener member 34 can be rotated to couple the top and base plates 22, 20.

As discussed above, in some embodiments, the base plate can be mounted to a board 14 or other riding device without being decoupled from the top plate 22. The pattern of the mounting holes 40 can vary depending on the specific board 14 or other riding device to which the base plate 20 is mounted. In general, the base plate 20, top plate 22, and locking mechanism 25 can be configured to be attached to a board 14 with standard mounting hardware, such as screws or bolts. To mount, the base plate 20 can be placed on the board 14 such that the mounting holes 40 generally align with corresponding holes in the board 14. The pull member 74 can be moved in an upward direction to disengage the insertion members 76 from the recesses 60 formed in the base plate 20. The top plate 22 then can be rotated independently of the base plate 20 such that the access hole 50 can be generally aligned with at least one of the mounting holes 42. The pull member 50 then can be released, thereby permitting the insertion members 76 to advance into the openings 60. A screw or other mounting hardware can be inserted into the mounting hole 40 and threadedly or otherwise engaged with the corresponding hole in the board 14. The pull member 50 can again be moved in an upward direction and the process can be repeated until the base plate 20 is sufficiently attached to the board 14.

If the board 14 or other riding device includes a binding device 12 or other apparatus to engage one's foot or boot, the binding device 12 can be placed on the top of the top plate 22 such that the pattern of holes in the binding device 12 generally align with the pattern of top plate mounting holes 52. Hardware can be inserted through the holes in the binding device 12 into the mounting holes 52 to sufficiently secure the binding device 12 to the top plate 22.

Once installed, a user can insert a foot or boot into the binding device 12. To change the angular orientation of the foot in relation to the board, the pull member 74 can be moved in an upward direction by pulling the attached strap 84, the finger hole 80, the lip on the pull member 74, and/or the pull member 74 in an upward direction. The top plate 22 can then be rotated with respect to the bottom plate 20 to the desired angular orientation, at which point the pull member 74 can be released so that the insertion members 76 advance through the openings 64 into the openings 60 under the bias of the springs 78. In some embodiments, the top plate 22 can be rotationally adjusted (i.e., rotated in a first direction or a second opposite direction) to better align the insertion members 76 with the recesses 60. Because the recess can be countersunk, however, and because the insertion members 76 can comprise tapering ends, the locking insertion members 76 can be easily guided into the recesses to ensure a positive lock against undesired rotation without rotationally adjusting the top plate 22. The adjustment process can be repeated as often as desired.

Figure 12:
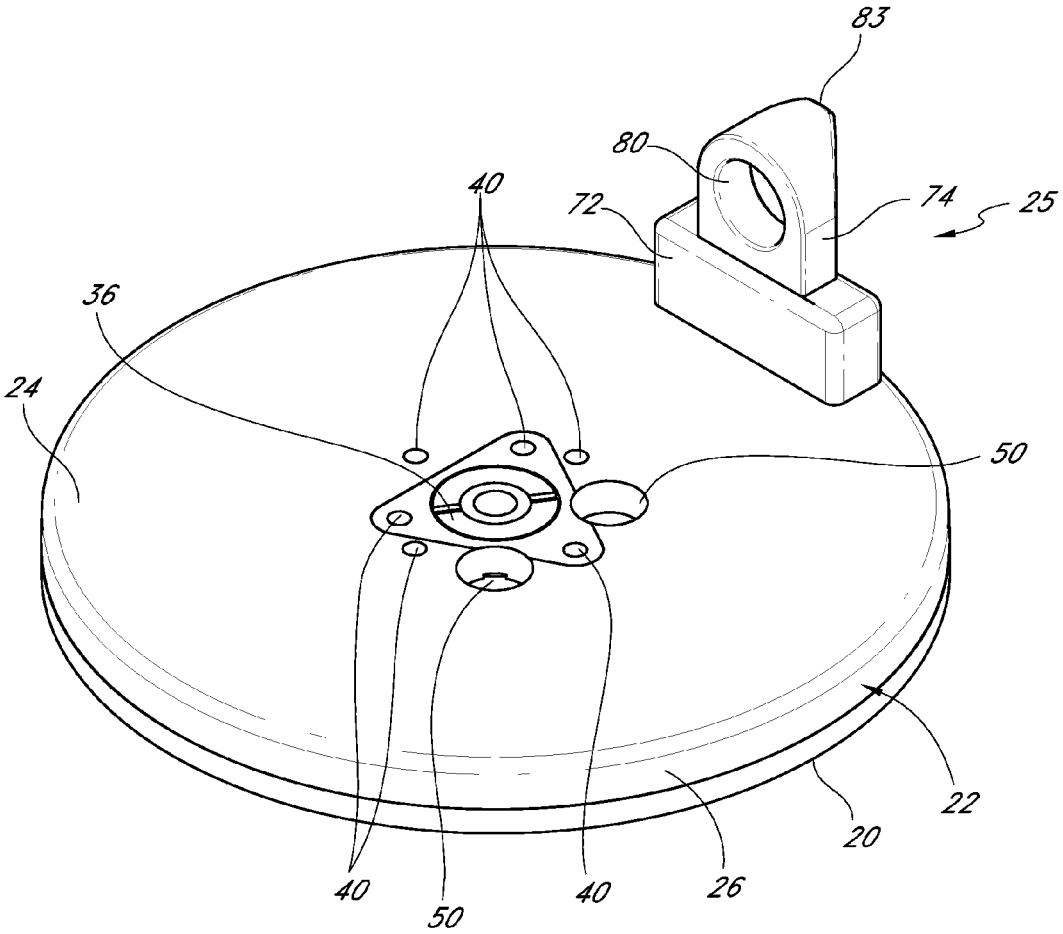
FIG. 12 is a perspective view of another embodiment of an adapter plate assembly.

FIG. 12 is a perspective view of another embodiment of an adapter plate assembly 10. In some embodiments, the adapter plate assembly 10 illustrated in FIG. 12 can have any of the same features, components, materials, configurations, and/or other details of any other adapter plate assembly disclosed herein. In some embodiments, the top threaded fastener member 36 can have a slotted channel formed through a portion thereof, the slotted channel being configured to receive a screwdriver or other similar tool for tightening the top threaded fastener member 36 to the bottom threaded fastener member 34 to couple the top plate 22 with the base plate 20. In some embodiments, as is illustrated, the top threaded fastener member 36 can have a hollow bore through a portion or all of the fastener member 36, which can be threaded or unthreaded.

Figure 14:
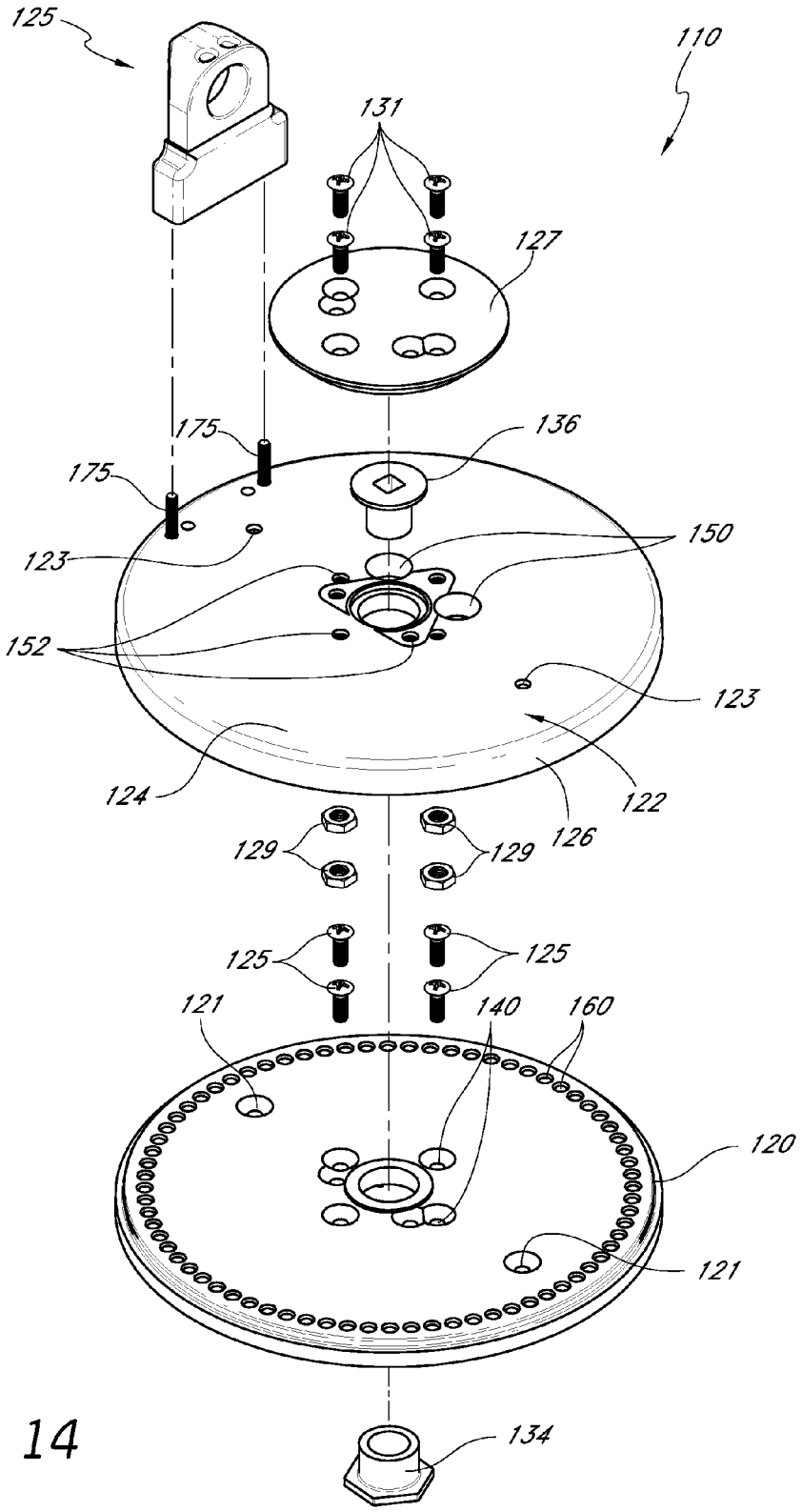
FIG. 14 is an exploded view of the embodiment of the adapter plate assembly illustrated in FIG. 13.
Figure 15:
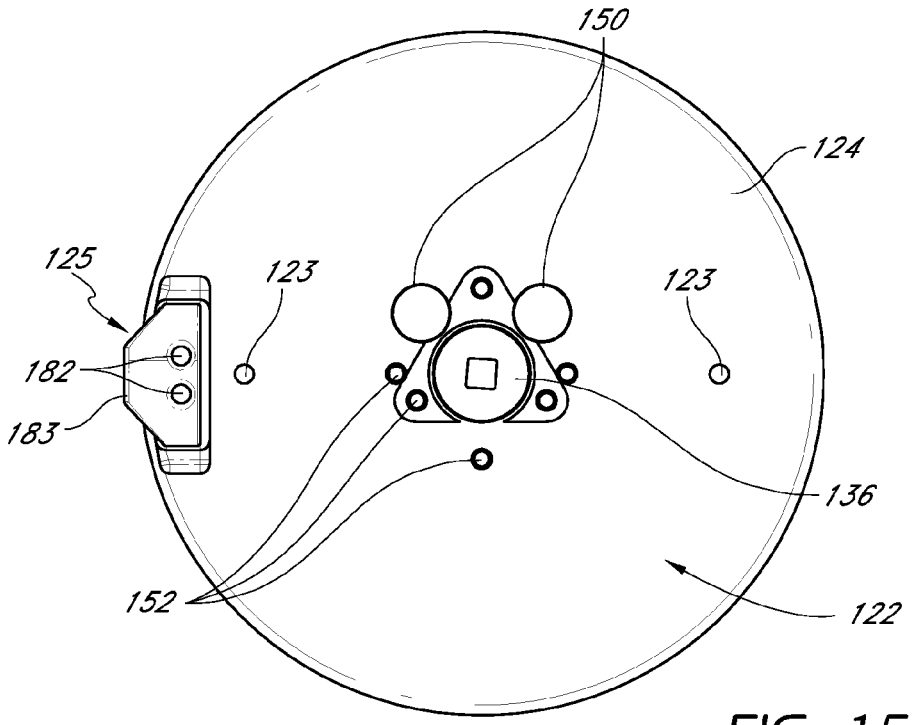
FIG. 15 is a top view of the embodiment of the adapter plate assembly illustrated in FIG. 13.
Figure 16:
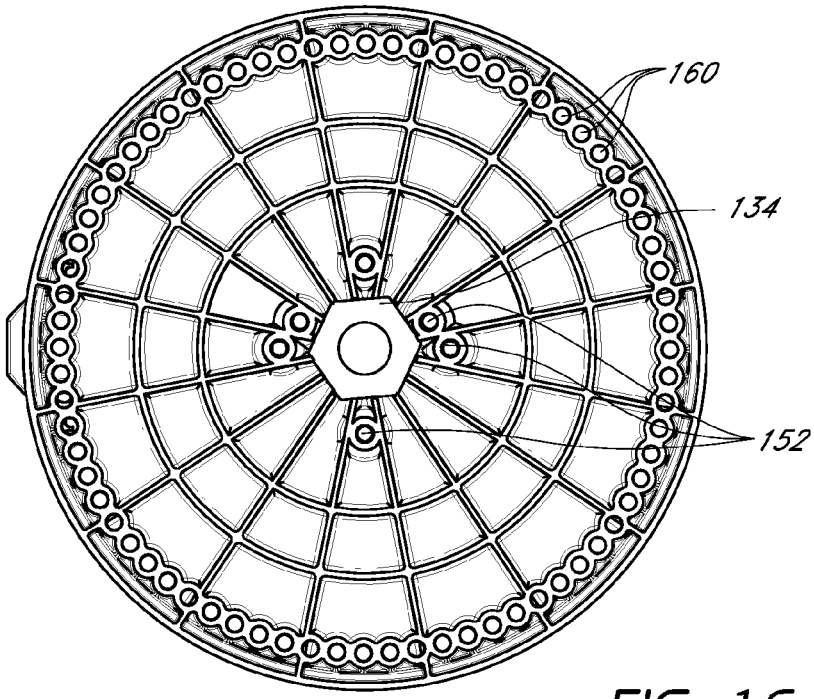
FIG. 16 is a bottom view of the embodiment of the adapter plate assembly illustrated in FIG. 13.
Figure 17:
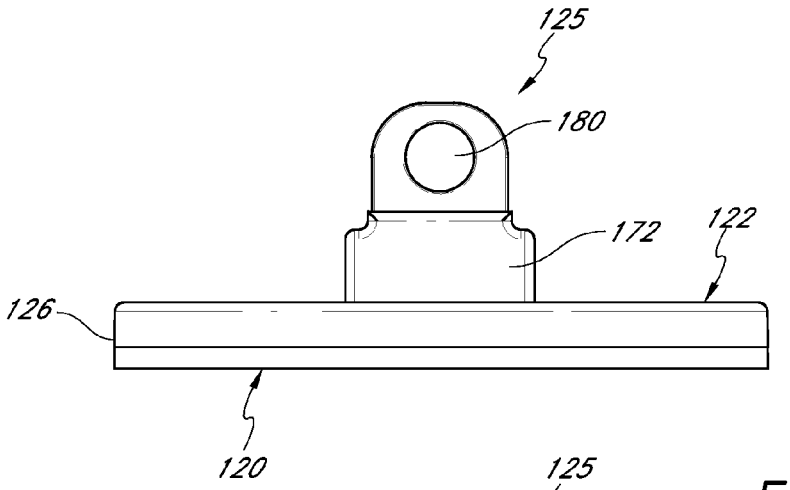
FIG. 17 is a front view of the embodiment of the adapter plate assembly illustrated in FIG. 13.
Figure 18:
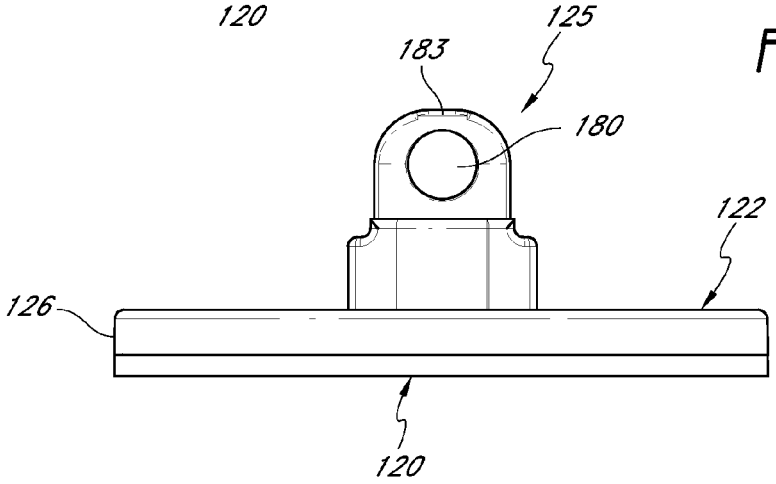
FIG. 18 is a back view of the embodiment of the adapter plate assembly illustrated in FIG. 13.
Figure 19:
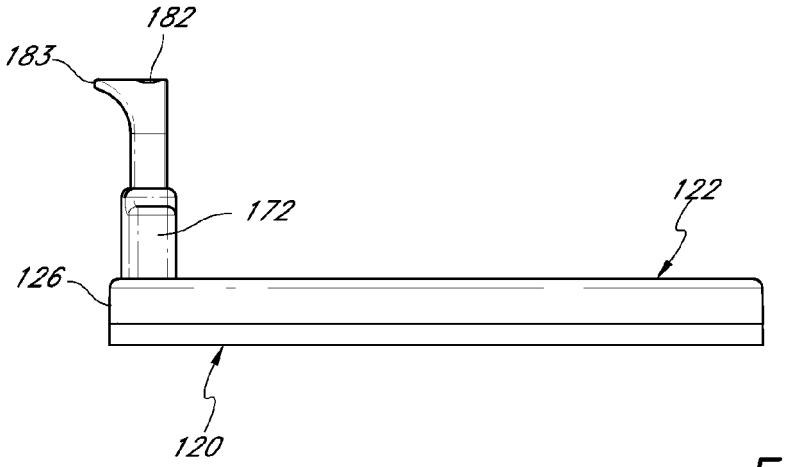
FIG. 19 is a side view of the embodiment of the adapter plate assembly illustrated in FIG. 13.

FIG. 13 is a perspective view of another embodiment of an adapter plate assembly 110. FIG. 14 is an exploded view of the embodiment of the adapter plate assembly 110 illustrated in FIG. 13. FIGS. 15-19 are a top, bottom, front, back, and side view, respectively, of the embodiment of the adapter plate assembly 110 and any components thereof illustrated in FIG. 13. In some embodiments, the adapter plate assembly 110 illustrated in FIGS. 13-19 can have any of the same features, components, materials, configurations, and/or other details of any other adapter plate assembly disclosed herein, and such other features, components, materials, configurations and/or other details can be combined with any of the following features. In some embodiments, although not required, the top threaded fastener member 136 can have a square depression or channel formed therein configured to receive a square head driver or tool for tightening the top threaded fastener member 36 to the bottom threaded fastener member 34 to couple the top plate 22 with the base plate 20. In some embodiments, the top threaded fastener member 36 can have the same details, configurations, and/or other details of any of the other embodiments disclosed herein.

With reference to FIG. 14, the base plate 120 (also referred to herein as a first plate or first member) can have a plurality of recesses 160 as in any other disclosed embodiments, mounting holes 140 for securing the base plate 120 to a recreational board. Additionally, the base plate 120 can have mounting holes 121 for securing the base plate 120 to recreational boards having slot type mounting components, such as without limitation the BURTON EST mounting system. Fasteners 125 or any other similar or suitable fasteners can be used for securing the base plate 120 to the desired recreational board. Access holes 150 in the top plate 122 can be used to insert the fasteners 125.

In some embodiments, the top plate 122 (also referred to herein as a top member or second member) can have a plurality of mounting holes 152 and/or mounting holes 123 (for BURTON EST bindings, for example) configured to receive fasteners 131 therein. Female threaded fasteners 129 can be, but are not required to be, used to threadingly receive the fasteners 131. The female fasteners 129 can be axially and rotationally supported by the top plate 122. The fasteners 129, 131 can be used to secure a center disk 127 of any desired binding to the adapter assembly 110. The center disk 127 illustrated is merely one simplified, non-limiting example of a component of a binding assembly that can be used with any of the adapter assembly embodiments disclosed herein. The locking mechanism 175 can be secured to the top plate 122 using fasteners 175.

The base plate 120, the top plate 122, and any other components of the adapter assembly 110 or any other embodiments disclosed herein can be made from plastic (including without limitation glass and/or fiber reinforced plastics), metal (including without limitation aluminum, steel, and/or any other suitable metals), composite materials, and/or any combination of the foregoing. Additionally, a lanyard or strap can be secured to the locking mechanism 175 through the holes 182, and the extension 183 can also be used to provide a gripping surface to a user trying to retract the locking mechanism.

In some embodiments, the apparatus can be mounted to a snowboard on top of the snowboard and under the front and/or rear bindings. Typically, the locking mechanism can be positioned on the instep side of the binding or on the outside of the foot but can be positioned in any other desired orientations. The apparatus can also be mounted on the rear binding in any of the described locations if the user so desires. Some embodiments of the adapter system 10, 110 can be mounted under the front binding, while a spacer plate or other similar object having a height or thickness approximately equal to the height of the adapter plate system 10, 110 can be mounted under the rear binding so that the user's bindings are both positioned at approximately the same height from the top surface of the board during use.

All of the features disclosed in this specification (including any accompanying exhibits, claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

Various modifications to the implementations described in this disclosure may be readily apparent to those skilled in the art, and the generic principles defined herein may be applied to other implementations without departing from the spirit or scope of this disclosure. Thus, the disclosure is not intended to be limited to the implementations shown herein, but is to be accorded the widest scope consistent with the principles and features disclosed herein. Certain embodiments of the invention are encompassed in the claim set listed below.

What is claimed is:

1. A rotationally adjustable binding mount configured to permit a user to adjust an angular orientation of a binding relative to a sport board without removing the user's foot therefrom, the binding mount comprising:

a base plate comprising:

a center opening that is coaxial with a center axis defined through the axial center of the binding mount;

a plurality of base plate mounting holes spaced apart from the center opening, the base plate mounting holes being sized and positioned to mount the base plate to a recreational board; and at least two pairs of recesses radially positioned in the base plate, wherein each recess is approximately equidistant from the center axis and each recess of each pair of recesses is separated by a fixed distance;

a top plate comprising:

a center opening that is coaxial with the center axis of the binding mount; and at least two top plate mounting holes spaced apart from the center opening of the top plate, a first threaded fastener extending through the center opening of the base plate, a second threaded fastener extending through the center opening of the top plate, the first threaded fastener and the second threaded fastener being coupled together and being configured to generally prevent axial movement of the top plate relative to the base plate;

a locking mechanism comprising:

a body member coupled with the top plate;

a top member; and a pair of insertion members each supported at a first end thereof by the top member and being configured to pass through the body member, the pair of insertion members being spaced apart from one another by a distance that is approximately equal to the fixed distance between each recess of each pair of recesses such that the pair of insertion members can engage with each pair of recesses;

wherein:

the top member is configured to move in an axial direction relative to the body member between a first and a second position, thereby causing the pair of insertion members to move between a first position wherein the pair of insertion members are axially spaced apart from each of the recesses of the base plate and a second position wherein the pair of insertion members are axially engaged with at least a pair of the recesses of the base plate; and the top plate is coupled with the base plate so that the top plate can rotate about the center axis relative to the base plate when the locking mechanism is in a first, disengaged position.

2. The binding mount of claim 1, further comprising one or more access openings formed in the top plate and spaced apart from the center opening, the access openings being configured to permit a user to access one or more of the plurality of mounting holes formed in the base plate by rotating the top plate until the access opening is sufficiently aligned with the mounting hole that a user can pass a fastener through the access opening and into the mounting hole and threadingly engage the fastener with the board without removing the top plate from the base plate.

3. The binding mount of claim 1, further comprising a pair of access holes formed in the top plate, the access holes being configured to permit a user to access one or more of the plurality of mounting holes formed in the base plate so that a user can attach the adapter plate to the board without removing the top plate from the base plate.

4. The binding mount of claim 1, wherein the insertion members are each biased toward the second position by one or more springs.

5. The binding mount of claim 1, wherein the insertion members pass through sealed openings formed in the body member of the locking mechanism, the sealed openings configured to substantially prevent water, moisture, snow, ice, dirt, or debris from entering the body member through the openings.

6. The binding mount of claim 1, wherein the base plate comprises a continuous array of equally spaced recesses.

7. The binding mount of claim 6, wherein each of the recesses is separated by approximately 4 degrees.

8. The binding mount of claim 1, further comprising a strap mounted to the top member such that a center portion of a first end of the strap is substantially aligned with a center of the top member.

9. The binding mount of claim 1, further comprising a bearing plate positioned between the top plate and the base plate.

10. A pair of binding mounts, comprising the rotationally adjustable binding mount of claim 1 for positioning beneath a forward-most binding, and an adapter plate comprising only a plate member for positing beneath a rearward-most binding.

11. A rotationally adjustable binding adapter configured to permit a user to adjust an angular orientation of a binding relative to a recreational board without removing the user's foot therefrom, the binding adapter comprising:

a first mounting member comprising:

a center opening that is coaxial with a center axis defined through the axial center of the binding adapter;

a plurality of mounting holes spaced apart from the center opening, the mounting holes being sized and positioned to mount the first mounting member to a recreational board; and at least two pairs of recesses radially positioned in the first mounting member, wherein each recess is approximately equidistant from the center axis and each recess of each pair of recesses is separated by a fixed distance;

a second mounting member comprising:

a center opening that is coaxial with the center axis of the binding adapter; and at least two mounting holes spaced apart from the center opening of the second mounting member for receiving mounting hardware for a binding;

a fastener element received within the center opening of the first mounting member and the center opening of the second mounting member to axially couple the first mounting member to the second mounting member such that the first mounting member and the second mounting member are generally secured against relative axial movement; and a locking element configured to move between at least a first position wherein the locking element is received by each recess of one or more of the at least two recesses and a second position wherein the locking element is configured to be spaced apart from all of the recesses of the at least two pairs of recesses such that the top mounting member is rotatable relative to the recreational board.

12. The binding adapter of claim 11, wherein the locking element comprises a pair of insertion members each supported at a first end thereof by the top member and being configured to pass through the body member, the pair of insertion members being spaced apart from one another by a distance that is approximately equal to the fixed distance between each recess of each pair of recesses such that the pair of insertion members can engage with each pair of recesses.

13. The binding adapter of claim 11, further comprising one or more access openings formed in the second mounting member and spaced apart from the center opening, the one or more access openings being alignable with at least one of the mounting holes of the first mounting member by rotating the second mounting member relative to the first mounting member.

14. The binding adapter of claim 11, further comprising a pair of access holes formed in the second mounting member, the access holes being configured to permit a user to access one or more of the plurality of mounting holes formed in the first mounting member so that a user can attach the adapter plate to the board without removing the second mounting member from the first mounting member.

15. The binding adapter of claim 11, further comprising a first fastener received by the center opening of the first mounting member coupled with second fastener received by the center opening of the second mounting member, the first and second threaded fasteners configured to prevent the axial movement of the second mounting member relative to the first mounting member.

16. The binding adapter of claim 11, wherein the first mounting member comprises a continuous array of equally spaced recesses.

17. A method of mounting a rotationally adjustable binding adapter for a sport boot binding to a sport board, the method comprising:

positioning the rotationally adjustable binding adapter on a top surface of the sport board, the rotationally adjustable binding adapter having a base plate, a top plate, a locking mechanism, and a mechanical fastener arrangement that is positioned coaxially with a center axis defined through an axial center of the sport boot binding, the mechanical fastener arrangement securing the base plate and the top plate against relative axial movement;

rotating the top plate relative to the base plate to align an access opening with a first mounting opening formed in the base plate;

advancing a first fastener through the access opening and the first mounting opening;

threadingly engaging the first fastener with a first threaded opening formed in the board;

rotating the top plate relative to the base plate to align the access opening with a second mounting opening formed in the base plate;

advancing a second fastener through the access opening and the second mounting opening; and threadingly engaging the second fastener with a second threaded opening formed in the board.

18. The method of claim 17, further comprising disengaging a locking mechanism supported by the top plate from engagement with the base plate before rotating the top plate relative to the base plate.

19. The method of claim 18, wherein disengaging the locking mechanism supported by the top plate from engagement with the base plate before rotating the top plate relative to the base plate comprises lifting a top member of the locking mechanism in an axial direction away from the base plate so as to disengage a pair of insertion members from the base plate.

20. The method of claim 17, further comprising releasing the locking mechanism so as to permit the locking mechanism to engage with the base plate to prevent the top plate from rotating relative to the base plate.

21. The method of claim 17, further comprising adjusting a rotational position of the top plate relative to the base plate by lifting up on the locking mechanism, rotating the top plate from a first rotational position to a second rotational position relative to the base plate, and releasing the locking mechanism so that the locking mechanism engages at least a pair of openings formed in the base plate.

* * * * *